US006593903B2

(12) United States Patent
Nakamura et al.

(10) Patent No.: US 6,593,903 B2
(45) Date of Patent: Jul. 15, 2003

(54) METHOD FOR DRIVING A PLASMA DISPLAY PANEL

(75) Inventors: Hideto Nakamura, Yamanashi (JP); Yuya Shiozaki, Yamanashi (JP); Tsutomu Tokunaga, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 239 days.

(21) Appl. No.: 09/873,219

(22) Filed: Jun. 5, 2001

(65) Prior Publication Data

US 2002/0018031 A1 Feb. 14, 2002

(30) Foreign Application Priority Data

Jun. 5, 2000 (JP) ..... 2000-168067

(51) Int. Cl.[7] ..... G09G 3/28
(52) U.S. Cl. ..... 345/60; 345/61
(58) Field of Search ..... 345/60, 61, 68, 345/77, 82, 596, 3.2, 88, 669, 96, 63

(56) References Cited

U.S. PATENT DOCUMENTS 5,309,168 A * 5/1994 Itoh et al. ..... 345/3.2
5,485,293 A * 1/1996 Robinder ..... 345/88
6,124,844 A * 9/2000 Ilbery ..... 345/596
6,188,382 B1 * 2/2001 Okamura et al. ..... 345/669
6,295,043 B1 * 9/2001 Hashimoto et al. ..... 345/96
6,340,960 B1 * 1/2002 Song et al. ..... 345/60
6,429,833 B1 * 8/2002 Ryeom et al. ..... 345/63

FOREIGN PATENT DOCUMENTS

EP 847037 A1 * 6/1998 ..... G09G/3/28

* cited by examiner

*Primary Examiner*—Steven Saras
*Assistant Examiner*—Uchendu O. Anyaso
(74) *Attorney, Agent, or Firm*—Sughrue Mion, PLLC

(57) ABSTRACT

A method for driving a plasma display panel is deviced to produce a high-quality image with an increased number of gradations. In each subfield, first and second picture element data write processes are executed for writing picture element data in each discharge cell belonging to first and second display areas of the plasma display panel. In addition, first and second light emission sustaining processes are executed for emitting discharge cells in the light emitting state out of the discharge cells belonging to the first and second display areas. In this process, in subfields with less weight among the subfields, the first light emission sustaining process is executed immediately after the completion of the first picture element data write process, the second picture element data write process is executed immediately after the completion of the first light emission sustaining process, and the second light emission sustaining process is executed immediately after the completion of the second picture element data write process.

13 Claims, 23 Drawing Sheets

PROIR ART

FIG. 7

| PD | | $PD_P$ | | PD | | $PD_P$ | |
|---|---|---|---|---|---|---|---|
| BRIGHT-NESS | 1 ~ 8 | BRIGHT-NESS | 1 ~ 8 | BRIGHT-NESS | 1 ~ 8 | BRIGHT-NESS | 1 ~ 8 |
| 0 | 00000000 | 0 | 00000000 | 64 | 01000000 | 56 | 00111000 |
| 1 | 00000001 | 0 | 00000000 | 65 | 01000001 | 57 | 00111001 |
| 2 | 00000010 | 1 | 00000001 | 66 | 01000010 | 57 | 00111001 |
| 3 | 00000011 | 2 | 00000010 | 67 | 01000011 | 58 | 00111010 |
| 4 | 00000100 | 3 | 00000011 | 68 | 01000100 | 59 | 00111011 |
| 5 | 00000101 | 4 | 00000100 | 69 | 01000101 | 60 | 00111100 |
| 6 | 00000110 | 5 | 00000101 | 70 | 01000110 | 61 | 00111101 |
| 7 | 00000111 | 6 | 00000110 | 71 | 01000111 | 62 | 00111110 |
| 8 | 00001000 | 7 | 00000111 | 72 | 01001000 | 63 | 00111111 |
| 9 | 00001001 | 7 | 00000111 | 73 | 01001001 | 64 | 01000000 |
| 10 | 00001010 | 8 | 00001000 | 74 | 01001010 | 65 | 01000001 |
| 11 | 00001011 | 9 | 00001001 | 75 | 01001011 | 65 | 01000001 |
| 12 | 00001100 | 10 | 00001010 | 76 | 01001100 | 66 | 01000010 |
| 13 | 00001101 | 11 | 00001011 | 77 | 01001101 | 67 | 01000011 |
| 14 | 00001110 | 12 | 00001100 | 78 | 01001110 | 68 | 01000100 |
| 15 | 00001111 | 13 | 00001101 | 79 | 01001111 | 69 | 01000101 |
| 16 | 00010000 | 14 | 00001110 | 80 | 01010000 | 70 | 01000110 |
| 17 | 00010001 | 14 | 00001110 | 81 | 01010001 | 71 | 01000111 |
| 18 | 00010010 | 15 | 00001111 | 82 | 01010010 | 72 | 01001000 |
| 19 | 00010011 | 16 | 00010000 | 83 | 01010011 | 72 | 01001000 |
| 20 | 00010100 | 17 | 00010001 | 84 | 01010100 | 73 | 01001001 |
| 21 | 00010101 | 18 | 00010010 | 85 | 01010101 | 74 | 01001010 |
| 22 | 00010110 | 19 | 00010011 | 86 | 01010110 | 75 | 01001011 |
| 23 | 00010111 | 20 | 00010100 | 87 | 01010111 | 76 | 01001100 |
| 24 | 00011000 | 21 | 00010101 | 88 | 01011000 | 77 | 01001101 |
| 25 | 00011001 | 21 | 00010101 | 89 | 01011001 | 77 | 01001101 |
| 26 | 00011010 | 22 | 00010110 | 90 | 01011010 | 78 | 01001110 |
| 27 | 00011011 | 23 | 00010111 | 91 | 01011011 | 79 | 01001111 |
| 28 | 00011100 | 24 | 00011000 | 92 | 01011100 | 80 | 01010000 |
| 29 | 00011101 | 25 | 00011001 | 93 | 01011101 | 81 | 01010001 |
| 30 | 00011110 | 26 | 00011010 | 94 | 01011110 | 82 | 01010010 |
| 31 | 00011111 | 27 | 00011011 | 95 | 01011111 | 83 | 01010011 |
| 32 | 00100000 | 28 | 00011100 | 96 | 01100000 | 84 | 01010100 |
| 33 | 00100001 | 28 | 00011100 | 97 | 01100001 | 85 | 01010101 |
| 34 | 00100010 | 29 | 00011101 | 98 | 01100010 | 86 | 01010110 |
| 35 | 00100011 | 30 | 00011110 | 99 | 01100011 | 86 | 01010110 |
| 36 | 00100100 | 31 | 00011111 | 100 | 01100100 | 87 | 01010111 |
| 37 | 00100101 | 32 | 00100000 | 101 | 01100101 | 88 | 01011000 |
| 38 | 00100110 | 33 | 00100001 | 102 | 01100110 | 89 | 01011001 |
| 39 | 00100111 | 34 | 00100010 | 103 | 01100111 | 90 | 01011010 |
| 40 | 00101000 | 35 | 00100011 | 104 | 01101000 | 91 | 01011011 |
| 41 | 00101001 | 36 | 00100100 | 105 | 01101001 | 92 | 01011100 |
| 42 | 00101010 | 36 | 00100100 | 106 | 01101010 | 93 | 01011101 |
| 43 | 00101011 | 37 | 00100101 | 107 | 01101011 | 93 | 01011101 |
| 44 | 00101100 | 38 | 00100110 | 108 | 01101100 | 94 | 01011110 |
| 45 | 00101101 | 39 | 00100111 | 109 | 01101101 | 95 | 01011111 |
| 46 | 00101110 | 40 | 00101000 | 110 | 01101110 | 96 | 01100000 |
| 47 | 00101111 | 41 | 00101001 | 111 | 01101111 | 97 | 01100001 |
| 48 | 00110000 | 42 | 00101010 | 112 | 01110000 | 98 | 01100010 |
| 49 | 00110001 | 43 | 00101011 | 113 | 01110001 | 99 | 01100011 |
| 50 | 00110010 | 43 | 00101011 | 114 | 01110010 | 100 | 01100100 |
| 51 | 00110011 | 44 | 00101100 | 115 | 01110011 | 101 | 01100101 |
| 52 | 00110100 | 45 | 00101101 | 116 | 01110100 | 101 | 01100101 |
| 53 | 00110101 | 46 | 00101110 | 117 | 01110101 | 102 | 01100110 |
| 54 | 00110110 | 47 | 00101111 | 118 | 01110110 | 103 | 01100111 |
| 55 | 00110111 | 48 | 00110000 | 119 | 01110111 | 104 | 01101000 |
| 56 | 00111000 | 49 | 00110001 | 120 | 01111000 | 105 | 01101001 |
| 57 | 00111001 | 50 | 00110010 | 121 | 01111001 | 106 | 01101010 |
| 58 | 00111010 | 50 | 00110010 | 122 | 01111010 | 107 | 01101011 |
| 59 | 00111011 | 51 | 00110011 | 123 | 01111011 | 108 | 01101100 |
| 60 | 00111100 | 52 | 00110100 | 124 | 01111100 | 108 | 01101100 |
| 61 | 00111101 | 53 | 00110101 | 125 | 01111101 | 109 | 01101101 |
| 62 | 00111110 | 54 | 00110110 | 126 | 01111110 | 110 | 01101110 |
| 63 | 00111111 | 55 | 00110111 | 127 | 01111111 | 111 | 01101111 |

FIG. 8

| PD | | $PD_P$ | | PD | | $PD_P$ | |
|---|---|---|---|---|---|---|---|
| BRIGHT-NESS | 1 ~ 8 | BRIGHT-NESS | 1 ~ 8 | BRIGHT-NESS | 1 ~ 8 | BRIGHT-NESS | 1 ~ 8 |
| 128 | 10000000 | 112 | 01110000 | 192 | 11000000 | 168 | 10101000 |
| 129 | 10000001 | 113 | 01110001 | 193 | 11000001 | 169 | 10101001 |
| 130 | 10000010 | 114 | 01110010 | 194 | 11000010 | 170 | 10101010 |
| 131 | 10000011 | 115 | 01110011 | 195 | 11000011 | 171 | 10101011 |
| 132 | 10000100 | 115 | 01110011 | 196 | 11000100 | 172 | 10101100 |
| 133 | 10000101 | 116 | 01110100 | 197 | 11000101 | 173 | 10101101 |
| 134 | 10000110 | 117 | 01110101 | 198 | 11000110 | 173 | 10101101 |
| 135 | 10000111 | 118 | 01110110 | 199 | 11000111 | 174 | 10101110 |
| 136 | 10001000 | 119 | 01110111 | 200 | 11001000 | 175 | 10101111 |
| 137 | 10001001 | 120 | 01111000 | 201 | 11001001 | 176 | 10110000 |
| 138 | 10001010 | 121 | 01111001 | 202 | 11001010 | 177 | 10110001 |
| 139 | 10001011 | 122 | 01111010 | 203 | 11001011 | 178 | 10110010 |
| 140 | 10001100 | 122 | 01111010 | 204 | 11001100 | 179 | 10110011 |
| 141 | 10001101 | 123 | 01111011 | 205 | 11001101 | 180 | 10110100 |
| 142 | 10001110 | 124 | 01111100 | 206 | 11001110 | 180 | 10110100 |
| 143 | 10001111 | 125 | 01111101 | 207 | 11001111 | 181 | 10110101 |
| 144 | 10010000 | 126 | 01111110 | 208 | 11010000 | 182 | 10110110 |
| 145 | 10010001 | 127 | 01111111 | 209 | 11010001 | 183 | 10110111 |
| 146 | 10010010 | 128 | 10000000 | 210 | 11010010 | 184 | 10111000 |
| 147 | 10010011 | 129 | 10000001 | 211 | 11010011 | 185 | 10111001 |
| 148 | 10010100 | 130 | 10000010 | 212 | 11010100 | 186 | 10111010 |
| 149 | 10010101 | 130 | 10000010 | 213 | 11010101 | 187 | 10111011 |
| 150 | 10010110 | 131 | 10000011 | 214 | 11010110 | 187 | 10111011 |
| 151 | 10010111 | 132 | 10000100 | 215 | 11010111 | 188 | 10111100 |
| 152 | 10011000 | 133 | 10000101 | 216 | 11011000 | 189 | 10111101 |
| 153 | 10011001 | 134 | 10000110 | 217 | 11011001 | 190 | 10111110 |
| 154 | 10011010 | 135 | 10000111 | 218 | 11011010 | 191 | 10111111 |
| 155 | 10011011 | 136 | 10001000 | 219 | 11011011 | 192 | 11000000 |
| 156 | 10011100 | 137 | 10001001 | 220 | 11011100 | 193 | 11000001 |
| 157 | 10011101 | 137 | 10001001 | 221 | 11011101 | 194 | 11000010 |
| 158 | 10011110 | 138 | 10001010 | 222 | 11011110 | 195 | 11000011 |
| 159 | 10011111 | 139 | 10001011 | 223 | 11011111 | 195 | 11000011 |
| 160 | 10100000 | 140 | 10001100 | 224 | 11100000 | 196 | 11000100 |
| 161 | 10100001 | 141 | 10001101 | 225 | 11100001 | 197 | 11000101 |
| 162 | 10100010 | 142 | 10001110 | 226 | 11100010 | 198 | 11000110 |
| 163 | 10100011 | 143 | 10001111 | 227 | 11100011 | 199 | 11000111 |
| 164 | 10100100 | 144 | 10010000 | 228 | 11100100 | 200 | 11001000 |
| 165 | 10100101 | 144 | 10010000 | 229 | 11100101 | 201 | 11001001 |
| 166 | 10100110 | 145 | 10010001 | 230 | 11100110 | 202 | 11001010 |
| 167 | 10100111 | 146 | 10010010 | 231 | 11100111 | 202 | 11001010 |
| 168 | 10101000 | 147 | 10010011 | 232 | 11101000 | 203 | 11001011 |
| 169 | 10101001 | 148 | 10010100 | 233 | 11101001 | 204 | 11001100 |
| 170 | 10101010 | 149 | 10010101 | 234 | 11101010 | 205 | 11001101 |
| 171 | 10101011 | 150 | 10010110 | 235 | 11101011 | 206 | 11001110 |
| 172 | 10101100 | 151 | 10010111 | 236 | 11101100 | 207 | 11001111 |
| 173 | 10101101 | 151 | 10010111 | 237 | 11101101 | 208 | 11011000 |
| 174 | 10101110 | 152 | 10011000 | 238 | 11101110 | 209 | 11010001 |
| 175 | 10101111 | 153 | 10011001 | 239 | 11101111 | 209 | 11010001 |
| 176 | 10110000 | 154 | 10011010 | 240 | 11110000 | 210 | 11010010 |
| 177 | 10110001 | 155 | 10011011 | 241 | 11110001 | 211 | 11010011 |
| 178 | 10110010 | 156 | 10011100 | 242 | 11110010 | 212 | 11010100 |
| 179 | 10110011 | 157 | 10011101 | 243 | 11110011 | 213 | 11010101 |
| 180 | 10110100 | 158 | 10011110 | 244 | 11110100 | 214 | 11010110 |
| 181 | 10110101 | 158 | 10011110 | 245 | 11110101 | 215 | 11010111 |
| 182 | 10110110 | 159 | 10011111 | 246 | 11110110 | 216 | 11011000 |
| 183 | 10110111 | 160 | 10010000 | 247 | 11110111 | 216 | 11011000 |
| 184 | 10111000 | 161 | 10100001 | 248 | 11111000 | 217 | 11011001 |
| 185 | 10111001 | 162 | 10100010 | 249 | 11111001 | 218 | 11011010 |
| 186 | 10111010 | 163 | 10100011 | 250 | 11111010 | 219 | 11011011 |
| 187 | 10111011 | 164 | 10100100 | 251 | 11111011 | 220 | 11011100 |
| 188 | 10111100 | 165 | 10100101 | 252 | 11111100 | 221 | 11011101 |
| 189 | 10111101 | 166 | 10100110 | 253 | 11111101 | 222 | 11011110 |
| 190 | 10111110 | 166 | 10100110 | 254 | 11111110 | 223 | 11011111 |
| 191 | 10111111 | 167 | 10100111 | 255 | 11111111 | 224 | 11100000 |

FIG. 13

| GRADATION | CONVERSION TABLE FOR 2ND DATA CONVERSION CIRCUIT 34 | | | | | | | | | | | | | | | LIGHT EMISSION PATTERN IN ONE FIELD | | | | | | | | | | | | | | LIGHT EMISSION BRIGHT-NESS |
|---|---|---|---|---|---|---|---|---|---|---|---|---|---|---|---|---|---|---|---|---|---|---|---|---|---|---|---|---|---|---|
| | PDs | GD | | | | | | | | | | | | | | SF | SF | SF | SF | SF | SF | SF | SF | SF | SF | SF | SF | SF | SF | |
| | | 1 | 2 | 3 | 4 | 5 | 6 | 7 | 8 | 9 | 10 | 11 | 12 | 13 | 14 | 1 | 2 | 3 | 4 | 5 | 6 | 7 | 8 | 9 | 10 | 11 | 12 | 13 | 14 | |
| 1 | 0000 | 1 | 0 | 0 | 0 | 0 | 0 | 0 | 0 | 0 | 0 | 0 | 0 | 0 | 0 | ● | | | | | | | | | | | | | | 0 |
| 2 | 0001 | 0 | 1 | 0 | 0 | 0 | 0 | 0 | 0 | 0 | 0 | 0 | 0 | 0 | 0 | ○ | ● | | | | | | | | | | | | | 1 |
| 3 | 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 4 | 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 5 | 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 6 | 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 7 | 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 8 | 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 9 | 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 10 | 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 11 | 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 12 | 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 13 | 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 14 | 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 15 | 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLE : SELECTIVE ERASING DISCHARGE
WHITE CIRCLE : LIGHT EMISSION

FIG. 19

| | | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|---|
| S1 | $I_{C1}$ | 2 | 6 | 10 | | 2 | 2 | 2 | 2 | 2 | 2 | 2 | 2 | 2 | |
| | $I_{C11}$ | | | | 2 | | | | | | | | | | |
| | $I_{C12}$ | | | | 2 | | | | | | | | | | |
| | $I_{C0}$ | | | | 12 | 18 | 24 | 30 | 36 | 42 | 48 | 54 | 62 | 68 | 76 |
| | LIGHT EMISSION FREQUENCY | 2 | 6 | 10 | 16 | 20 | 26 | 32 | 38 | 44 | 50 | 56 | 64 | 70 | 76 |
| | BRIGHTNESS RATIO | 1 | 3 | 5 | 8 | 10 | 13 | 16 | 19 | 22 | 25 | 28 | 32 | 35 | 38 |
| S2 | $I_{C2}$ | 2 | 6 | 10 | | 2 | 2 | 2 | 2 | 2 | 2 | 2 | 2 | 2 | |
| | $I_{C21}$ | | | | 2 | | | | | | | | | | |
| | $I_{C22}$ | | | | 2 | | | | | | | | | | |
| | $I_{C0}$ | | | | 12 | 18 | 24 | 30 | 36 | 42 | 48 | 54 | 62 | 68 | 76 |
| | LIGHT EMISSION FREQUENCY | 2 | 6 | 10 | 16 | 20 | 26 | 32 | 38 | 44 | 50 | 56 | 64 | 70 | 76 |
| | BRIGHTNESS RATIO | 1 | 3 | 5 | 8 | 10 | 13 | 16 | 19 | 22 | 25 | 28 | 32 | 35 | 38 |

SF1
SF2
SF3
SF4
SF5
SF(N)
S1
S2
S3
S4
1ST LINE
p-TH LINE
(p+1)TH LINE
k-TH LINE
(k+1)TH LINE
v-TH LINE
(v+1)TH LINE
n-TH LINE
T4 T5 T6
Rc
E

METHOD FOR DRIVING A PLASMA DISPLAY PANEL

BACKGROUND OF THE INVENTION

1. Field of the Invention

The present invention relates to a method for driving a plasma display panel.

2. Description of the Related Background Art

Recently, in line with the increase in the screen size of display apparatuses, the need of thin-shape display apparatuses is increasing, and various kinds of thin display devices have been put into practical use. Much attention is now being paid to an alternate discharge type of plasma display panel as one such thin display device.

FIG. 1 is a schematic configuration of a plasma display apparatus comprising such a plasma display panel and a driver to drive this display panel.

In FIG. 1, the plasma display panel PDP 10 comprises m column electrodes $D_{1-Dm}$, and n row electrodes $X_{1-Xn}$ and n row electrodes $Y_{1-Yn}$ which intersect each of the column electrodes. A pair of $X_i$ ($1 \leqq i \leqq n$) and $Y_i$ ($1 \leqq i \leqq n$) of the row electrodes $X_{i-Xn}$ and $Y_{i-Yn}$ form the 1st to n-th display lines of the PDP 10. A discharge space containing discharge gas is formed between the column electrode D and the row electrodes X and Y. The intersection of each row electrode and each column electrode with the discharge space in between forms a discharge cell responsible for a picture element.

Each discharge cell emits light by the discharge effect, so each cell can take only two states, namely, a "light emitting" state and a "non-light emitting" state. That is, each discharge cell can show only two gradations, namely, a minimum brightness (non-light emitting state) and a maximum brightness (light emitting state).

Therefore, the driver 100 performs gradation drive by using the subfield method in order to display half-tone brightness corresponding to a video signal supplied to the PDP 10.

In the subfield method, the input video signal is converted into, for example, 4-bit picture element data corresponding to each picture element. In this case, as is shown in FIG. 2, one field is formed of four subfields SF1–SF4, corresponding to each of the four bits.

FIG. 3 shows various kinds of driving pulses by the driver 100 to be supplied to the row electrodes and the column electrodes of the PDP 10 in one subfield and such pulse supply timing.

In the first place, the driver 100 first supplies positive reset pulses $RP_X$ to the row electrodes $X_{1-Xn}$, and negative reset pulses $RP_Y$ to the row electrodes $Y_{1-Yn}$ during a simultaneous reset process Rc. In response to the supply of these reset pulses $RP_X$ and $RP_Y$, all the discharge cells of the PDP 10 are reset and discharged and a predetermined wall charge is uniformly formed in each discharge cell. Immediately after, the driver 100 supplies erasing pulses EP to the row electrodes $X_{1-Xn}$ of the PDP 10 at the same time. Because of the supply of said erasing pulses, erasing discharge is performed in each discharge cell and the above-mentioned wall charge disappears. Therefore, all the discharge cells in the PDP 10 are initialized to the "non-light emitting cell" state.

Next, during the picture element data write process Wc, the driver 100 separates each bit of the above-mentioned 4-bit picture element data, matching said bit to the subfields SF1–SF4, and generates picture element data pulses having a pulse voltage corresponding to the logical level of said bit. For example, during the picture element data write process Wc for the subfield SF1, the driver 100 generates picture element data pulses having a pulse voltage corresponding to the logical level of the first bit of said picture element data. In this case, the driver 100 generates picture element data pulses of high voltage when the logical level of the first bit is "1" and it generates picture element data pulses of low voltage (0 volt) when said logical level is "0". In addition, the driver 100 supplies said picture element data pulses to the column electrodes $D_{1-Dm}$ sequentially as picture element data pulse groups $DP_{1-DPn}$ for one display line corresponding to one of the 1st to n-th display lines as is shown in FIG. 3. In addition, the driver 100 generates negative scanning pulses SP as shown in FIG. 3 in synchronization with the supply timing of each picture element data pulse group DP, and supplies said scanning pulses to the row electrodes $Y_1$–$Y_n$ sequentially. In this case, only a discharge cell at the intersection of a display line to which said scanning pulses SP were supplied and a "column" to which picture element data pulses of high voltage were supplied discharges (selective erasing discharge). After the completion of said selective write discharge, a wall charge is formed in the discharge cell. Thereby, a discharge cell which was initialized to the "non-light emitting cell" state during the above-mentioned simultaneous reset process Rc is set to the "light emitting cell" state. On the other hand, a discharge cell to which the scanning pulses SP were supplied and at the same time low voltage picture element data pulses were also supplied does not perform the above-mentioned selective write discharge. Thus, this discharge cell is sustained at the state initialized during said simultaneous reset process Rc, namely, at the "non-light emitting cell" state. That is, by the execution of the picture element data write process Wc, each discharge cell in the PDP 10 is set to the "light emitting cell" state or the "non-light emitting cell" state according to the input video signal.

Next, during a light emission sustaining process IC, the driver 100 supplies positive sustaining pulses $IP_X$ and positive light emission sustaining pulses $IP_Y$ as shown in FIG. 3 to the row electrodes $X_1$–$X_n$ and the row electrodes $Y_1$–$Y_n$ alternately and repeatedly. The supply frequency (or the supply period) of these sustaining pulses $IP_X$ and $IP_Y$ in one subfield is set according to the weight of each subfield as is shown in FIG. 2. In this case, only a discharge cell containing a wall charge, namely, only "light emitting cells" perform sustaining discharge each time these sustaining pulses $IP_X$ and $IP_Y$ are supplied to such cells. That is, only discharge cells set to the "light emitting cell" state during said picture element data write process Wc emit light by sustaining discharge by a frequency set according to the weight of each subfield as is shown in FIG. 2.

The driver 100 performs the above-mentioned operation for each subfield. In this case, the half-tone brightness corresponding to the video signal is expressed according to the sum (in one field) of the frequency of said light sustaining discharges in each subfield.

The number of the gradations of brightness which can be expressed by said subfield method increases in proportion to the number of divided subfields. Because the display period of one field is predetermined, it is necessary to narrow the pulse width of the various kinds of driving pulses as is shown in FIG. 3 in order to increase the number of the subfields. However, an erroneous discharge may take place by narrowing the pulse width of the driving pulses if the number of charged particles remaining in a discharge cell is small. Therefore, a problem was that high image quality cannot always be obtained.

SUMMARY OF THE INVENTION

An object of the present invention is to provide a solution to these problems. The present invention provides a method for driving a plasma display panel capable of displaying a high-quality image.

A method for driving a plasma display panel according to the present invention is a method for driving the gradations of a plasma display panel in which a discharge cell responsible for a picture element is formed at each intersection between each row electrode corresponding to each display line and each column electrode intersected with said row electrode by using each field of an input video signal comprising a plurality of subfields characterized in that: in each of said subfields, a first picture element data write process is executed in response to picture element data corresponding to said input video signal, for setting said discharge cells belonging to each of a plurality of said display lines responsible for a first display area of said plasma display panel to either a light emitting cell state or a non-light emitting cell state; a second picture element data write process is executed in response to said picture element data, for setting said discharge cells belonging to each of a plurality of said display lines responsible for a second display area of said plasma display panel to either said light emitting cell state or said non-light emitting cell state; a first light emission sustaining process is executed for causing only the discharge cells in light emitting cell state of said discharge cells belonging to said first display area by a frequency corresponding to the weight of said subfield; a second light emission sustaining process is executed for causing only the discharge cells in light emitting state of said discharge cells belonging to said second display area by a frequency corresponding to the weight of said subfield: in a subfield with less weight of each of said subfield, said first light emission sustaining process is executed immediately after the completion of said first picture element data write process and said second picture element data write process is executed immediately after the completion of said first light emission sustaining process, and said second light emission sustaining process is executed immediately after the completion of said second picture element data write process.

BRIEF DESCRIPTION OF THE DRAWINGS

FIG. 7 shows an example of a conversion table for a first data conversion circuit 32.

FIG. 8 shows an example of a conversion table for a first data conversion circuit 32.

FIG. 13 shows a conversion table for a second data conversion circuit 34 and a light emission pattern in one field.

FIG. 19 shows the frequency of sustaining discharges for each subfield.

DETAILED DESCRIPTION OF THE PREFERRED EMBODIMENT

The embodiments of the present invention will be described below with reference to the accompanying drawings.

Figure 1:
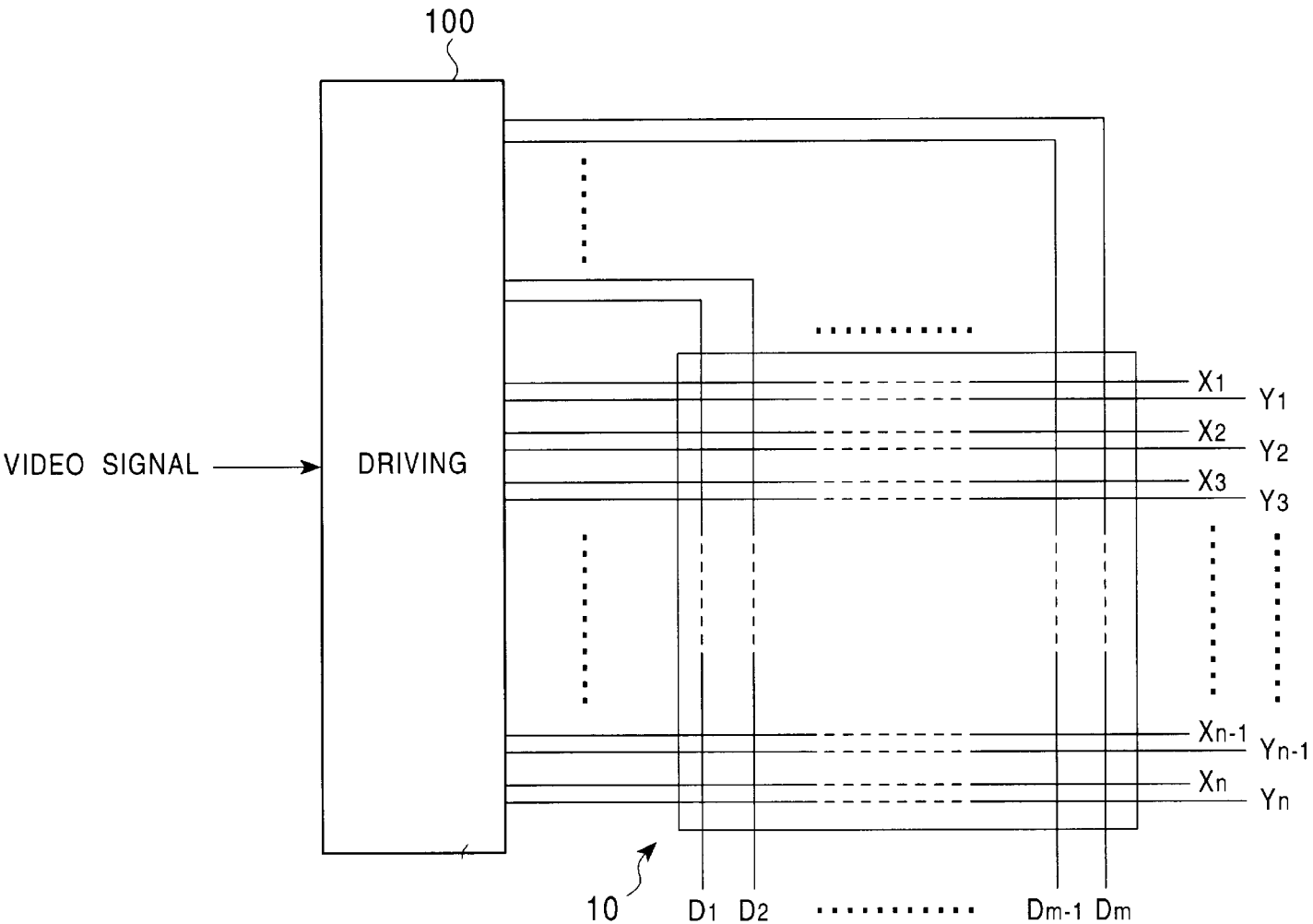
FIG. 1 is a schematic diagram showing the configuration of a plasma display apparatus.
Figure 2:
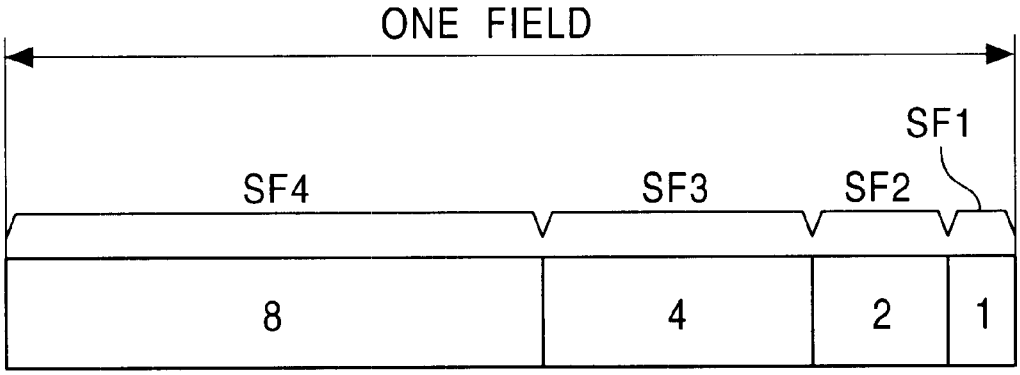
FIG. 2 PRIOR ART
FIG. 2 is a diagram showing an example of a light emission driving format.
Figure 3:
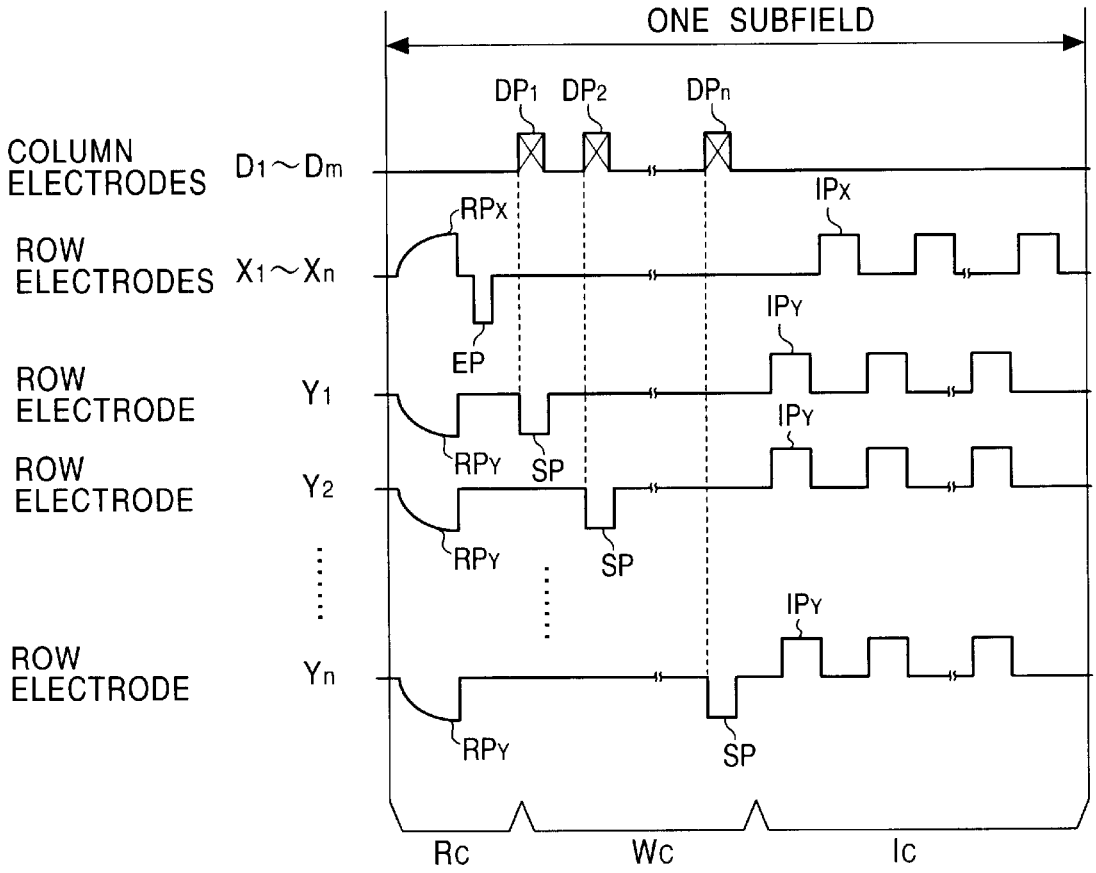
FIG. 3 PRIOR ART
FIG. 3 shows driving pulses to be supplied to the column electrodes and the row electrodes of the PDP 10 in one subfield and the supply timing thereof.
Figure 4:
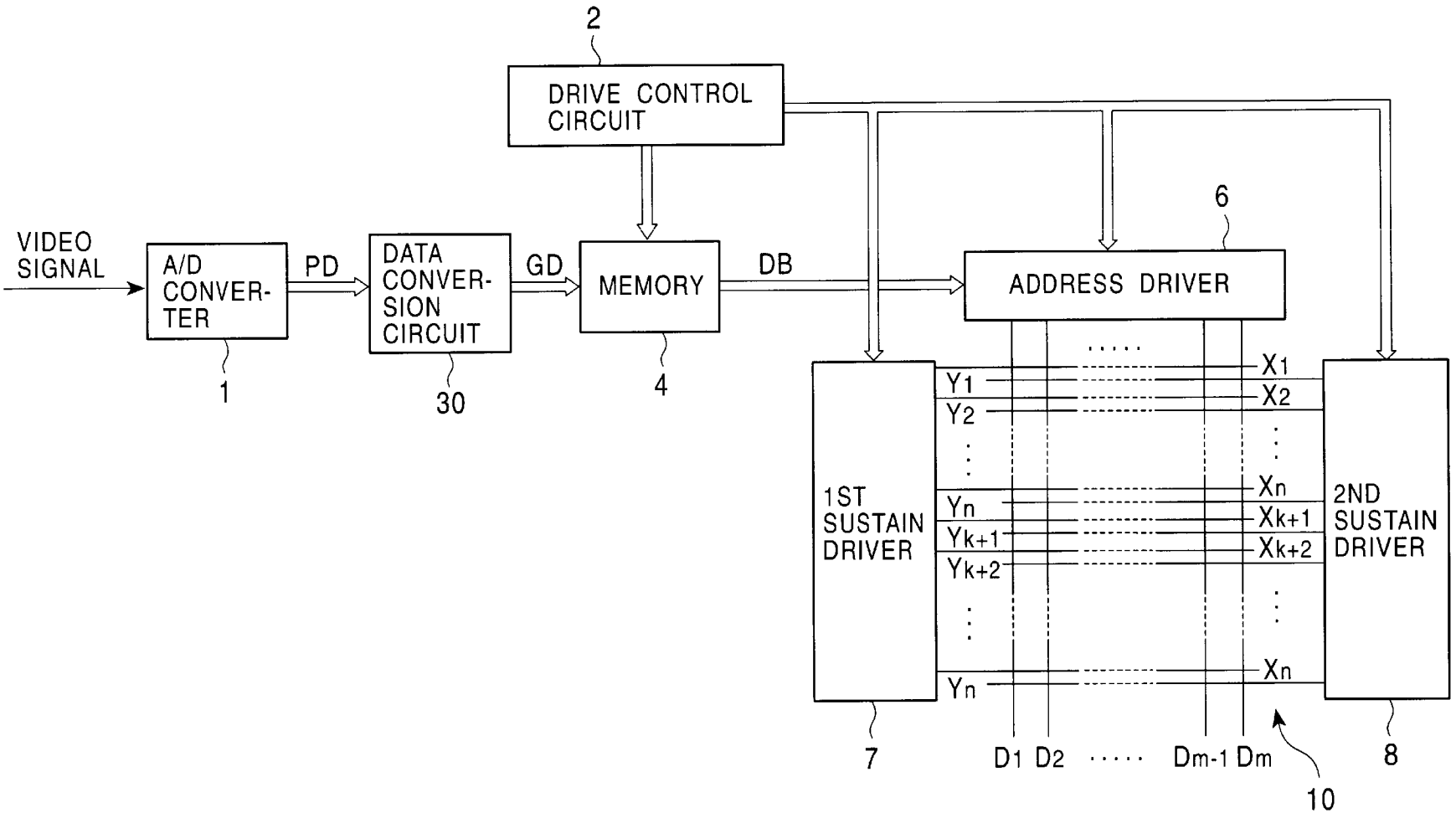
FIG. 4 is a diagram schematically showing the configuration of a plasma display apparatus for driving a plasma display panel in accordance with the driving method of the present invention.

FIG. 4 is a diagram showing the schematic configuration of a plasma display apparatus for driving a plasma display panel in accordance with the driving method of the present invention.

In FIG. 4, the plasma display panel PDP 10 comprises m column electrodes $D_1$–$D_m$, and n row electrodes $X_1$–$X_n$ and $Y_1$–$Y_n$ which intersect each of these column electrodes. Each of the row electrodes $X_1$–$X_n$ and $Y_1$–$Y_n$ form the 1st display line to the n-th display line in the PDP 10 as a pair of $X_i$ ($1 \leqq i \leqq n$) and $Y_i$ ($1 \leqq i \leqq n$). A discharge space filled with discharge gas is formed between the column electrode D and the row electrodes X and Y. It is so configured that a discharge cell corresponding to a picture element is formed at the intersection of each row electrode pair and each column electrode containing said discharge space.

An A/D converter 1 samples an input analog video signal, converts the sampled signal, for example, into 8-bit picture element data PD corresponding to each picture element, and sends the picture element data PD to a data conversion circuit 30.

Figure 5:
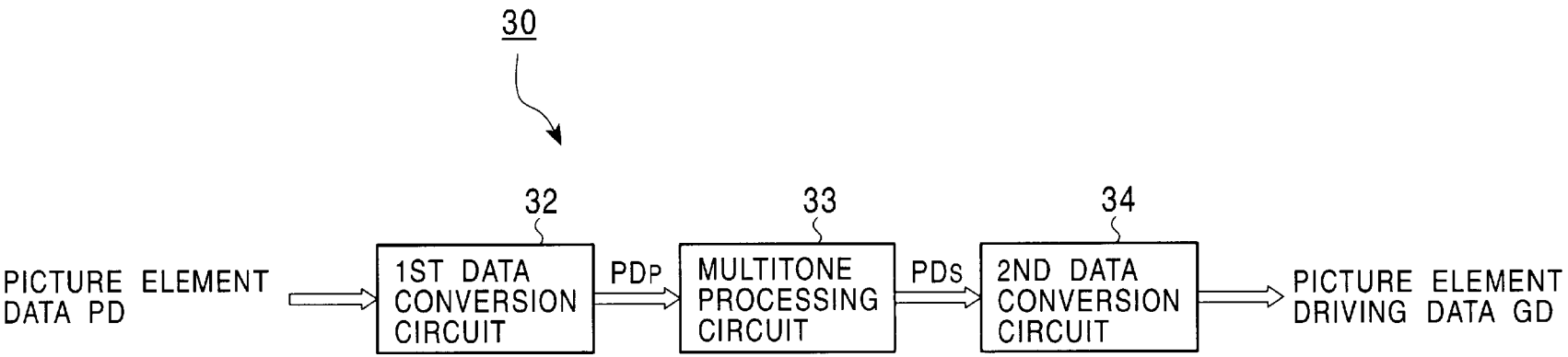
FIG. 5 is a diagram showing the internal configuration of a data conversion circuit 30.

FIG. 5 is a diagram showing the internal configuration of the data conversion circuit 30.

Figure 6:
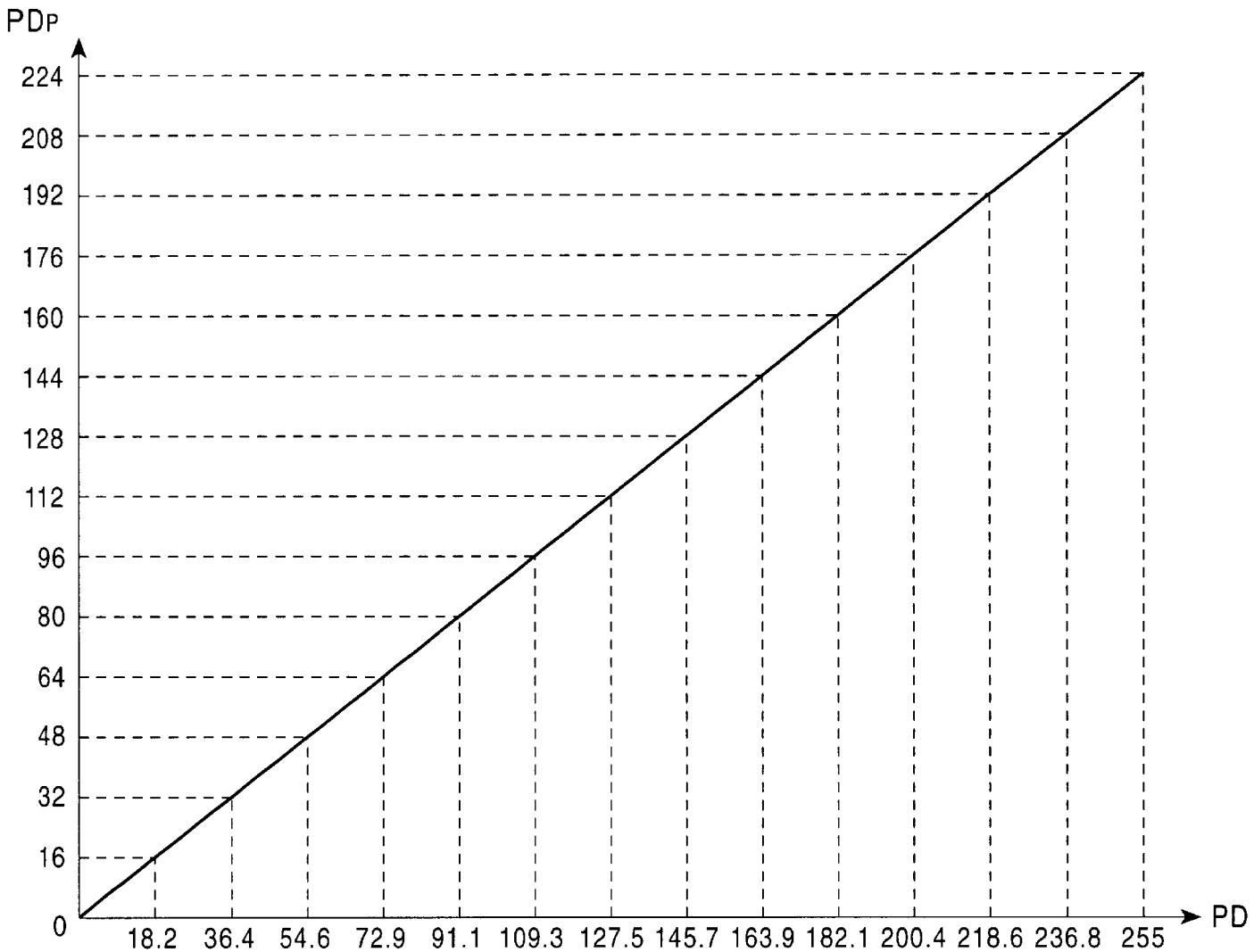
FIG. 6 is a diagram showing the conversion characteristics in a first data conversion circuit 32.

In FIG. 5, a first data conversion circuit 32 converts the picture element data PD which can express brightness of "0"–"255" by using 8 bits into brightness controlled picture element data $PD_P$ having the brightness range controlled as "0"–"224" by using 8 bits. Practically, the first data conversion circuit 32 converts said picture element data PD into brightness controlled picture element data $PD_P$ in accordance with a conversion table as shown in FIGS. 7 and 8 which is based on the conversion characteristics shown in FIG. 6. That is, the first data conversion circuit 32 performs the data conversion as described above on picture element data PD so as to prevent the occurrence of brightness saturation due to multitone processing performed by a multitone processing circuit 33 to be described and the occurrence of flat parts caused in the display characteristics (occurrence of the gradation distortion) which appear when a display gradation is not at a bit boundary. Then the first data conversion circuit 32 sends the brightness controlled picture element data $PD_P$ obtained by said data conversion to the multitone processing circuit 33.

The multitone processing circuit 33 performs multitone processing such as error dispersion processing, dither processing and the like on said 8-bit brightness controlled picture element data $PD_p$. Thereby, the multitone processing circuit 33 obtains multitone picture element data $PD_s$ with the number of bits compressed to 4 while sustaining the number of tones of brightness represented visibly at nearly 256.

Figure 9:
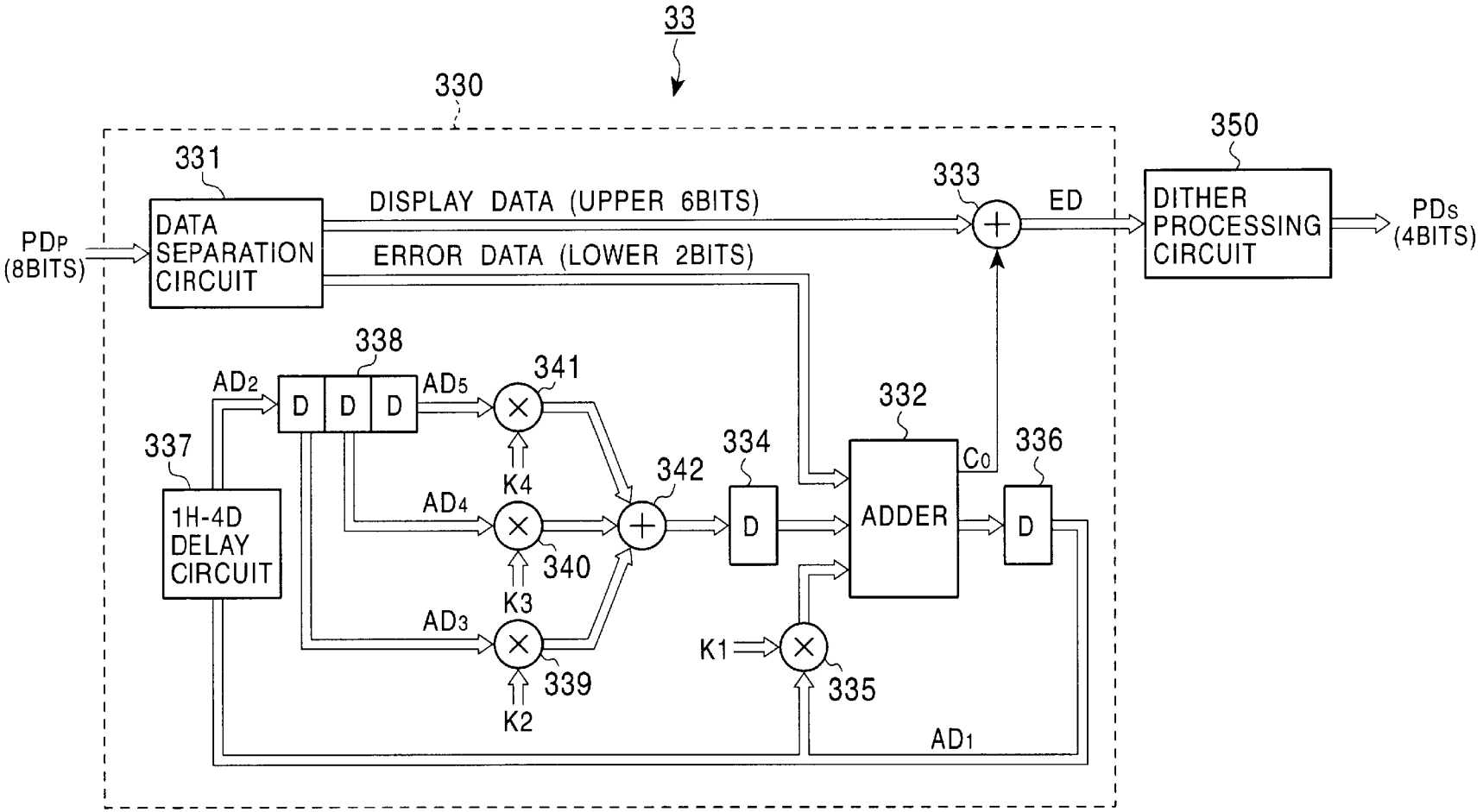
FIG. 9 is a diagram showing the internal configuration of a multitone processing circuit 33.

FIG. 9 is a diagram showing the internal configuration of the multitone processing circuit 33.

As is shown in FIG. 9, said multitone processing circuit 33 comprises an error dispersion processing circuit 330 and a dither processing circuit 350.

First, a data separation circuit 331 in the error dispersion processing circuit 330 separates the lower two bits of the 8-bit brightness controlled picture element data $PD_p$ sent from the first data conversion circuit 32 as error data and the upper six bits thereof as display data. An adder 332 adds said error data to the delay output from a delay circuit 334, and the multiplication output from a coefficient multiplier 335, and sends the added value obtained to a delay circuit 336. The delay circuit 336 delays the added value sent from the adder 332 by a delay time D having the same time as the sampling period of said picture element data PD, and send such delayed value to the coefficient multiplier 335 and a delay circuit 337 as delayed addition signal $AD_1$. The coefficient multiplier 335 multiplies said delayed addition signal $AD_1$ by a predetermined coefficient $K_1$ (for example, "7/16"), and sends the multiplied result to the adder 332. A delay circuit 337 further delays said delayed addition signal $AD_1$ by a time of (1 horizontal scanning period—said delay time D×4), and sends the further delayed result to a delay circuit 338 as a delayed addition signal $AD_2$. The delay circuit 338 further delays said delayed addition signal $AD_2$ by said delay time D, and sends the result to a coefficient multiplier 339 as a delayed addition signal $AD_3$. The delay circuit 338 further delays said delayed addition signal $AD_2$ by the time of said delay time D×2, and sends the result to a coefficient multiplier 340 as a delayed addition signal $AD_4$. In addition, the delay circuit 338 delays said delayed addition signal $AD_2$ by the time of said delay time D×3, and sends the result to a coefficient multiplier 341 as a delayed addition signal $AD_5$. The coefficient multiplier 339 multiplies said delayed addition signal $AD_3$ by a predetermined coefficient $K_2$ (for example, "3/16"), and sends the multiplied result to an adder 342. The coefficient multiplier 340 multiplies said delayed addition signal $AD_4$ by a predetermined coefficient $K_3$ (for example, "5/16"), and sends the multiplied result to the adder 342. The coefficient multiplier 341 multiplies said delayed addition signal $AD_5$ by a predetermined coefficient $K_4$ (for example, "1/16"), and sends the multiplied result to the adder 342. The adder 342 adds the multiplied results sent from the coefficient multipliers 339, 340 and 341, and sends an adding signal obtained by that addition to the delay circuit 334. The delay circuit 334 delays said adding signal by said delay time D, and sends it to the adder 332. The adder 332 generates a carry out signal $C_o$ of logical level "0" when there is no carry to the result of addition of error data sent from the data separation circuit 331, delay output from the delay circuit 334, and multiplication output from the coefficient multiplier 335, and generates a carry out signal $C_o$ of logical level "1" when there is carry, and sends said signal to an adder 333. The adder 333 adds said carry out signal $C_o$ to the display data sent from the data separation circuit 331, and outputs the result as 6-bit error dispersion processing picture element data ED.

Figure 10:
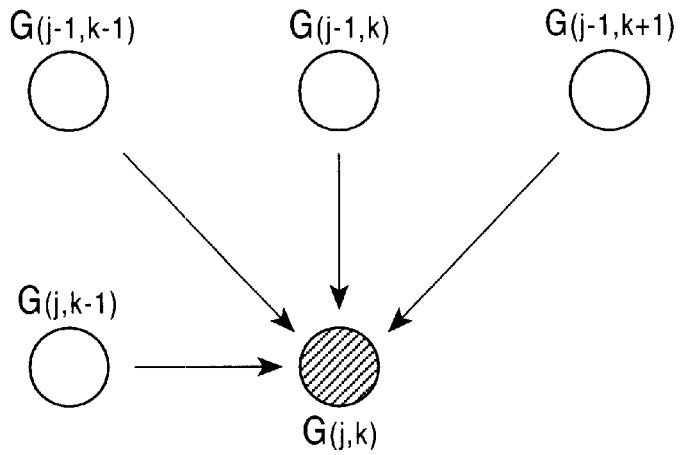
FIG. 10 is a diagram describing the operation of an error dispersion processing circuit 330.

The operation performed by the error dispersion processing circuit 330 will be described below using an example in which error dispersion processing picture element data ED corresponding to the picture element G (j, k) shown in FIG. 10 are obtained.

First, error data corresponding to picture element G (j, k−1) to the left of said picture element G (j, k), picture element G (j−1, k−1) to the upper left thereof, picture element G (j−1, k) directly above thereof, and picture element G (j−1, k+1) to the upper right thereof respectively are shown below.

Error data corresponding to picture element G (j, k−1): delayed addition signal $AD_1$ Error data corresponding to picture element G (j−1, k+1): delayed addition signal $AD_3$ Error data corresponding to picture element G (j−1, k): delayed addition signal $AD_4$ Error data corresponding to picture element G (j−1, k−1): delayed addition signal $AD_5$ Each of these error data is added by the adder 332, being given the weight of the predetermined coefficients $K_1$–$K_4$ as described above. The adder 332 further adds the lower two bits of the brightness controlled picture element data $PD_P$, namely, error data corresponding to the picture element G (j, k), to the result of addition. The adder 333 obtains error dispersion processing picture element data ED by adding a carry out signal $C_o$ which is output from the adder 332 to the upper six bits of the brightness controlled picture element data $PD_P$, namely, display data contained in the picture element G (j, k), and sends the error dispersion processing picture element data ED to a dither processing circuit of the next stage.

That is, the error dispersion processing circuit 330 regards the upper six bits of brightness controlled picture element data $PD_P$ as display data, and regards lower two bits thereof as error data. Then the error dispersion processing circuit 330 obtains error dispersion processing picture element data ED by influencing said display data with said error data corresponding to each peripheral picture element G (j, k−1), G (j−1, k+1), G (j−1, k), and G (j−1, k−1) after the weighted addition. By such operation, the brightness of the lower two bits of the original picture element {G(j, k)} is artificially represented by the above-mentioned peripheral picture elements. Therefore, it becomes possible to display brightness tones equal to 8-bit picture element data PD by using a smaller number of bits than eight, namely, by using display data of six bits. In this case, if a coefficient for error dispersion is uniformly added to each picture element, the quality of the image may be deteriorated because noise due to the error dispersion pattern sometimes becomes visible. In order to cope with this problem, error dispersion coefficients $K_1$–$K_4$ to be allocated to each of the four picture elements may be changed for each field (or each frame) display period in the same manner as the case of dither coefficients to be described.

The dither processing circuit 350 shown in FIG. 9 performs dither processing on error dispersion processing picture element data ED sent from said error dispersion processing circuit 330. Dither processing is performed in order to represent one intermediate brightness by using a plurality of adjoining picture elements. For example, the addition is performed by grouping four picture elements adjoining on the right and left and above and below each other into one group, then allocating one of four dither coefficients a–d having different values from each other to each picture element data corresponding to each picture element of one group respectively. By said dither processing, four kinds of combinations of different intermediate display levels for four picture elements are possible. However, if the dither pattern of the dither coefficients a–d is uniformly added to each picture element, the quality of the image may be deteriorated because noise due to this dither pattern is sometimes visible.

Therefore, the dither processing circuit 350 is designed so that said dither coefficients a–d to be allocated to each of four picture elements are changed for each display period of one field (or one frame).

Figure 11:
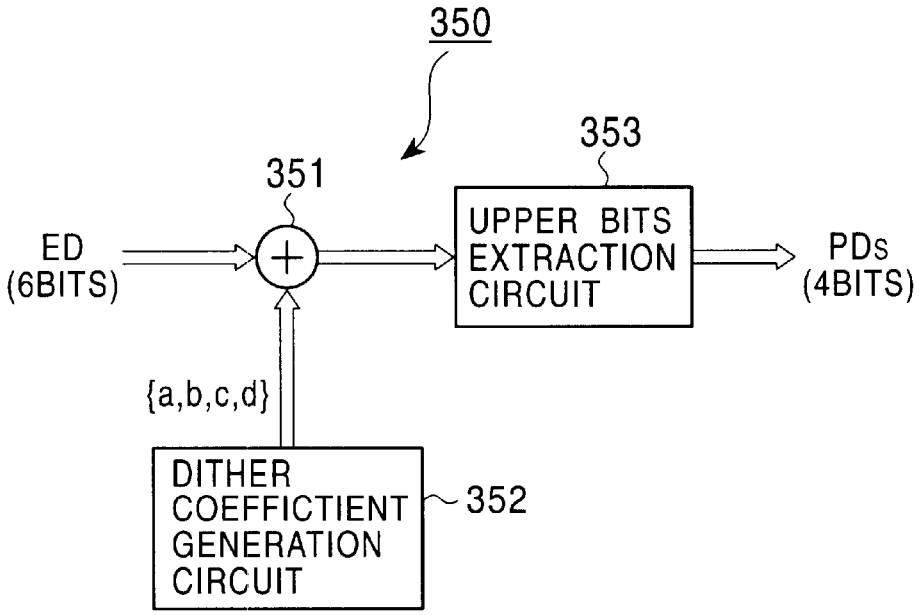
FIG. 11 is a diagram showing the internal configuration of a dither processing circuit 350.

FIG. 11 is a diagram showing the internal configuration of the dither processing circuit 350.

Figure 12:
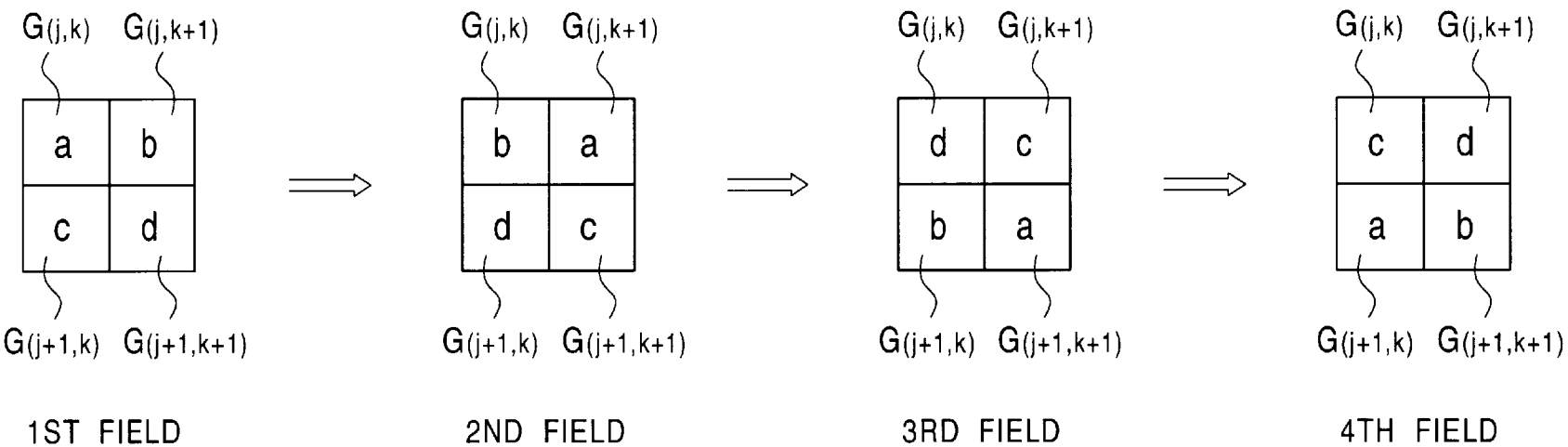
FIG. 12 is a diagram describing the operation of a dither processing circuit 350.

In FIG. 11, the dither coefficient generation circuit 352 generates dither coefficients a, b, c and d to be allocated to each of four picture elements adjoining each other as shown in FIG. 12, namely, picture element G (j, k), picture element G (j, k+1), picture element G (j+1, k), and picture element G (j+1, k+1), and sends these coefficients to an adder 351. In this case, the dither coefficient generation circuit 352 changes said dither coefficients a–d to be allocated to each of the four picture elements for each display period of one field (or one frame), as shown in FIG. 12.

That is, the dither coefficients a–d are generated so as to be allocated to each picture element as follows.

In the first field,

Picture element G (j, k): dither coefficient a

Picture element G (j, k+1): dither coefficient b

Picture element G (j+1, k): dither coefficient c

Picture element G (j+1, k+1): dither coefficient d

In the second field,

Picture element G (j, k): dither coefficient b

Picture element G (j, k+1): dither coefficient a

Picture element G (j+1, k): dither coefficient d

Picture element G (j+1, k+1): dither coefficient c

In the third field,

Picture element G (j, k): dither coefficient d

Picture element G (j, k+1): dither coefficient c

Picture element G (j+1, k): dither coefficient b

Picture element G (j+1, k+1): dither coefficient a, and

In the fourth field,

Picture element G (j, k): dither coefficient c

Picture element G (j, k+1): dither coefficient d

Picture element G (j+1, k): dither coefficient a

Picture element G (j+1, k+1): dither coefficient b

The operation for the first field through the fourth field is executed repeatedly. That is, the operation returns to that in the first field when the dither coefficient generation operation in the fourth field is completed, and the above-mentioned operation is repeated.

The adder 351 adds each of said dither coefficients a–d to error dispersion processing picture element data ED corresponding to each of picture element G (j, k), picture element G (j, k+1), picture element G (j+1, k), and picture element G (j+1, k+1) respectively, and sends the dither added picture element data obtained to an upper bit extraction circuit 353.

In the first field shown in FIG. 12, for example, the adder 351 sends each of the following values as the dither added picture element data to the upper bit extraction circuit 353.

Error dispersion processing picture element data ED corresponding to picture element G (j, k)+dither coefficient a Error dispersion processing picture element data ED corresponding to picture element G (j, k+1)+dither coefficient b Error dispersion processing picture element data ED corresponding to picture element G (J+1, k)+dither coefficient c Error dispersion processing picture element data ED corresponding to picture element G (j+1, k+1)+dither coefficient d The upper bit extraction circuit 353 extracts the upper four bits of said dither added picture element data, and sends them to a second data conversion circuit 34 shown in FIG. 5 as multitone picture element data $PD_s$.

The second data conversion circuit 34 converts said 4-bit multitone picture element data $PD_s$ into 14-bit picture element driving data GD in accordance with a conversion table as shown in FIG. 13, and sends said converted data to the memory 4.

The memory 4 writes said picture element driving data GD sequentially in accordance with a write signal coming from the drive control circuit 2. Each time the writing of picture element driving data GD for one screen is completed, the memory 4 performs a read operation described below. Said picture element driving data GD for one screen contains (n×m) picture element driving data GD including picture element driving data $GD_{11}$ corresponding to the picture element of the first row and the first column through picture element driving data $GD_{nm}$ corresponding to the picture element of the n-th row and the m-th column.

First, the memory 4 regards the first bit which is the least significant bit of each picture element driving data $GD_{11}$–$GD_{nm}$ as picture element driving data bits $DB1_{11}$–$DB1_{nm}$. Then the memory 4 reads these bits by one display line at a time, and sends them to an address driver 6. Next, the memory 4 regards the second bit of each picture element driving data $GD_{11}$–$GD_{nm}$ as picture element driving data bits $DB2_{11}$–$DB2_{nm}$. Then the memory 4 reads these bits by one display line at a time, and sends them to the address driver 6. In the same manner, the memory 4 regards the remaining third bit through fourteenth bit of picture element driving data GD as picture element driving data bits DB3–DB14 and reads each bit by one display line at a time, and sends them to the address driver 6.

The memory 4 reads said picture element driving data bits DB1–DB14 sequentially at the timing matched to each of the subfields SF1–SF14 to be described.

Figure 14:
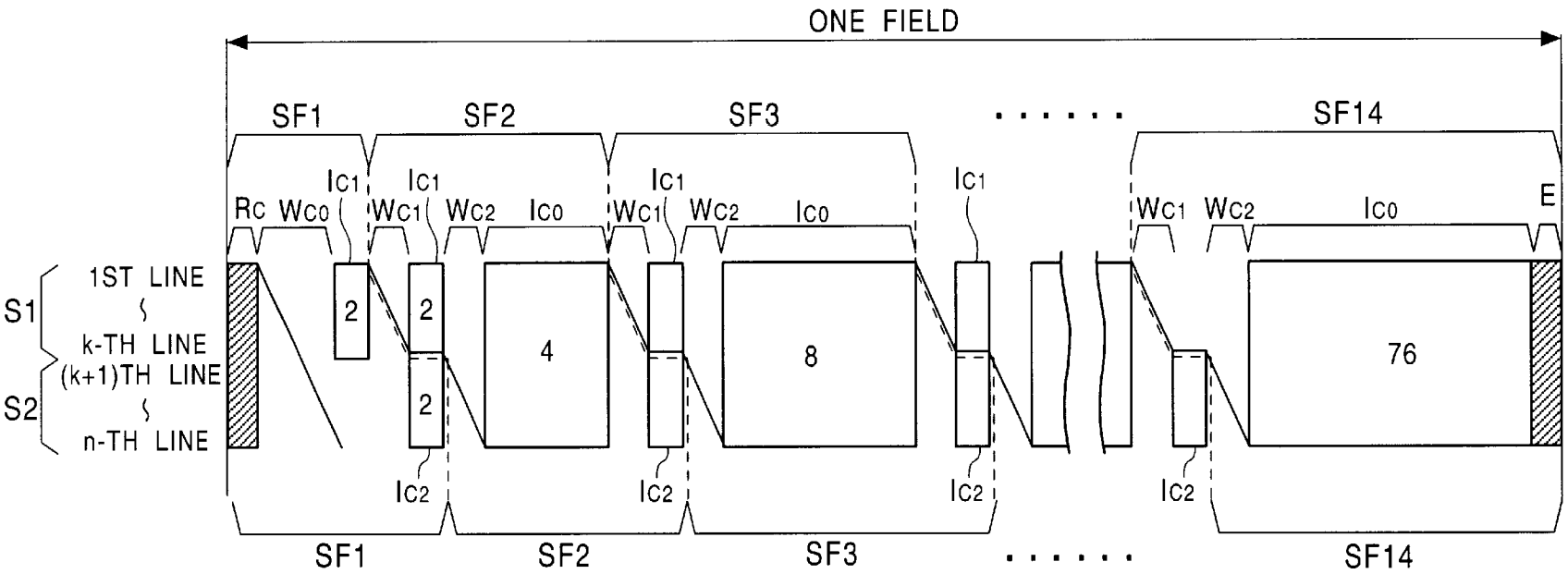
FIG. 14 shows an example of a light emission format.

The drive control circuit 2 generates various kinds of timing signals for driving the gradation of the PDP 10 in accordance with the light emission driving format shown in FIG. 14, and sends the signals to the driver comprising the address driver 6, a first sustain driver 7 and a second sustain driver 8.

According to the light emission driving format shown in FIG. 14, the display period of one field (or one frame) of an input video signal is divided into four subfields SF1–SF14. In this case, in the first subfield SF1, said driver executes a simultaneous reset process Rc, a picture element data write process Wc0, a divided light emission sustaining process Ic1, and a divided light emission sustaining process Ic2 sequentially. In each of the subsequent subfields SF2–SF13, the driver executes a first picture element data write process Wc1, a divided light emission sustaining process Ic1, a second picture element data write process Wc2, a simultaneous light emission sustaining process Ic0, and a divided light emission sustaining process Ic2 sequentially. In the last subfield SF14, the driver executes a first picture element data write process Wc1, a second picture element data write process Wc2, a simultaneous light emission sustaining process Ic0, and an erasing process E sequentially.

Figure 15:
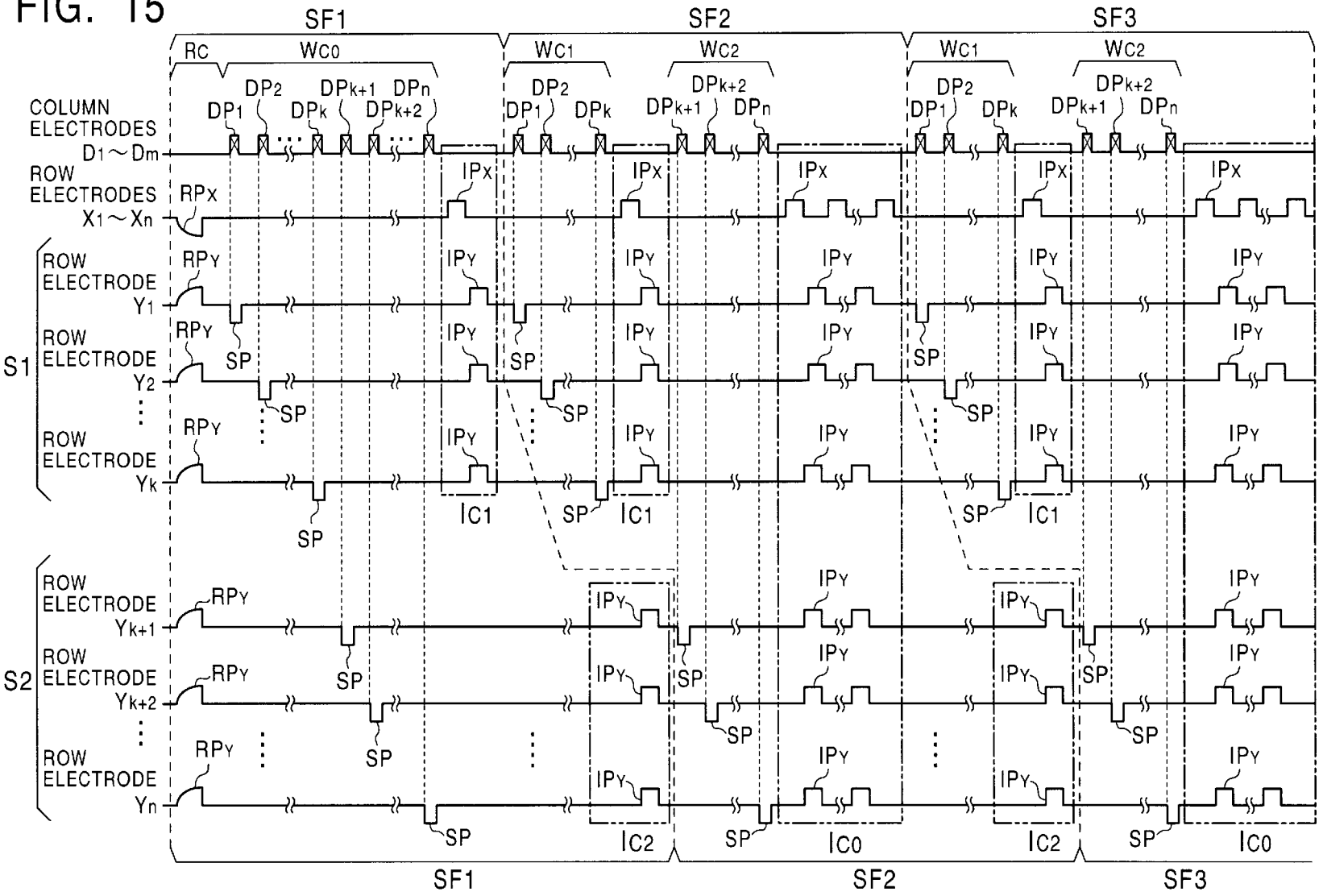
FIG. 15 is a diagram showing various kinds of driving pulses to be supplied to the column electrodes and the row electrodes of the PDP 10 in accordance with the light emission driving format shown in FIG. 14 and their supply timing.

FIG. 15 is a diagram showing various kinds of driving pulses to be supplied to the PDP 10 by the address driver 6, the first sustain driver 7 and the second sustain driver 8 in accordance with the light emission driving format shown in FIG. 14, and their supply timing.

In FIG. 15, only the subfields SF1–SF3 are shown being extracted out of the subfields SF1–SF14.

As is shown in FIG. 14, during the simultaneous reset process Rc which is performed only in the first subfield SF1, the first sustain driver 7 generates negative reset pulses $RP_X$ as shown in FIG. 15, and supplies the pulses to the row electrodes $X_1$–$X_n$. In addition, during the simultaneous reset process Rc, simultaneously with the supply of said reset pulses $RP_X$, the second sustain driver 8 generates positive reset pulses $RP_Y$, and supplies the pulses to the row electrodes $Y_1$–$Y_n$. In response to the supply of these reset pulses $RP_X$ and $RP_Y$, a reset discharge is generated in all the discharge cells of the PDP 10, and a predetermined amount of wall charge is formed uniformly in each discharge cell. By the simultaneous reset process Rc, all the discharge cells of the PDP 10 are initialized to the "light emitting cell" state once.

During the picture element data write process Wc0 performed next, the address driver 6 generates (n×m) picture element data pulses containing a pulse voltage corresponding to the logical level of each of the picture element driving data bits $DB1_{11}$–$DB1_{nm}$ which are read from the memory 4. For example, the address driver 6 generates picture element data pulses of high voltage when the logical level of the picture element driving data bit is "1", and generates picture element data pulses of low voltage (0 volt) when the logical level is "0". Then the address driver 6 matches the (n×m) picture element data pulses to each of the 1st to n-th display lines, groups them into picture element data pulse groups $DP_1$–$DP_n$ for each display line, and supplies the pulse groups to the column electrodes $D_1$–$D_m$ sequentially, as shown in FIG. 15. During this time, the second sustain driver 8 generates negative scanning pulses SP at the supply timing of each of said picture element data pulse groups $DP_1$–$DP_n$, and supplies the pulses to the row electrodes $Y_1$–$Y_n$ sequentially, as shown in FIG. 15. In this case, a discharge is generated only in a discharge cell at the intersection of a display line to which the scanning pulses SP are supplied and a "column" to which the picture element data pulses of high voltage are supplied (selective erasing discharge). By the selective erasing discharge, the wall charge which had been formed during said simultaneous reset process Rc disappears, and the discharge cell is shifted to the "non-light emitting cell" state. On the other hand, the above-mentioned selective erasing discharge is not generated in a discharge cell to which the scanning pulses SP are supplied and at the same time the low voltage picture element data pulses are also supplied. Thus, this discharge cell is sustained at the "light emitting cell" state. That is, by this picture element data write process Wc0, each discharge cell of the PDP 10 is set to either the "light emitting cell" state or the "non-light emitting cell" state in accordance with picture element data PD. Thus, what is called picture element data write is performed.

After the execution of the picture element data write process Wc0, the driver executes the divided light emission sustaining process Ic1, as shown in FIG. 14.

During the divided light emission sustaining process Ic1, first, the first sustain driver 7 simultaneously supplies positive sustaining pulses $IP_X$ as shown in FIG. 15 to the row electrodes $X_1$–$X_k$ which form the display area S1, the upper half screen of the PDP 10. In addition, immediately after the supply of the sustaining pulses $IP_X$, the second sustain driver 8 simultaneously supplies positive sustaining pulses $IP_Y$ as shown in FIG. 15 to the row electrodes $Y_1$–$Y_k$ which form said display area S1. By this divided light emission sustaining process Ic1, only discharge cells in which a wall charge exists out of the discharge cells belonging to the display area S1, namely, only "light emitting cells" generate a sustaining discharge each time the sustaining pulses $IP_Y$ and $IP_X$ are supplied thereto, and the pulse light is emitted for two frequencies.

After the execution of the divided light emission sustaining process Ic1, the driver executes the first picture element data write process Wc1 of the subfield SF2, as shown in FIG. 14.

During the first picture element data write process Wc1 of the subfield SF2, the address driver 6 first extracts picture element driving data bits $DB2_{11}$–$DB2_{km}$ corresponding to the display area S1 out of the picture element driving data bits $DB2_{11}$–$DB2_{nm}$ read from the memory 4. Next, the address driver 6 generates (k×m) picture element data pulses containing a pulse voltage corresponding to the logical level of each of these picture element driving data bits $DB2_{11}$–$DB2_{km}$. Then the address driver 6 matches the (k×m) picture element data pulses to each of the 1st to k-th display lines which form the display area S1, groups them into picture element data pulse groups $DP_1$–$DP_k$ for each display line, and supplies the $DP_1$–$DP_k$ to the column electrodes $D_1$–$D_m$ sequentially, as shown in FIG. 15. During this time, the second sustain driver 8 generates negative scanning pulses SP at the supply timing of each of the picture element data pulse groups $DP_1$–$DP_k$, and supplies the pulses to the row electrodes $Y_1$–$Y_k$ sequentially, as shown in FIG. 15. In this case, a selective erasing discharge is generated only in a discharge cell at the intersection of a display line to which the scanning pulses SP are supplied and a "column" to which the picture element data pulses of a high voltage are supplied. By the selective erasing discharge, the wall charge which had been formed in the discharge cell disappears, and the discharge cell is shifted to the "non-light emitting cell" state. On the other hand, the selective erasing discharge is not generated in a discharge cell to which the scanning pulses SP are supplied and at the same time low voltage picture element data pulses are also supplied. Thus, the discharge cell is sustained at the same state as immediately before the pulse supply. That is, a discharge cell which is at the "light emitting cell" state immediately before the supply of scanning pulses SP maintains its "light emitting cell" state. On the other hand, a discharge cell which is at the "non-light emitting cell" state immediately before the supply of scanning pulses SP maintains its "non-light emitting cell" state as it is. By the picture element data write process Wc1 of the subfield SF2, each discharge cell belonging to the display area S1, the upper half of the screen, out of the discharge cells of the PDP 10 is set to either the "light emitting cell" state or the "non-light emitting cell" state in accordance with picture element data PD, and what is called picture element data write is performed.

After the completion of the first picture element data write process Wc1 of the subfield SF2, the driver executes the divided light emission sustaining process Ic1 of the subfield SF2, as shown in FIG. 14.

During the divided light emission sustaining process Ic1 of the subfield SF2, first, the first sustain driver 7 simultaneously supplies positive sustaining pulses $IP_X$ as shown in FIG. 15 to the row electrodes $X_1$–$X_k$ which form the display area S1, the upper half of the PDP 10. Immediately after the supply of the sustaining pulses $IP_X$, the second sustain driver 8 simultaneously supplies positive sustaining pulses $IP_Y$ as shown in FIG. 15 to the row electrodes $Y_1$–$Y_k$ which form the display area S1. By the divided light emission sustaining process Ic1, only discharge cells in which a wall charge exists out of the discharge cells belonging to the display area S1, namely, only "light emitting cells" generate a sustaining discharge each time the sustaining pulses $IP_Y$ and $IP_X$ are supplied thereto, and the pulse light is emitted for two frequencies.

The driver then executes the divided light emission sustaining process Ic2 of the subfield SF1 simultaneously with the divided light emission sustaining process Ic1, as shown in FIG. 15.

During the divided light emission sustaining process Ic2 of the subfield SF1, first, the first sustain driver 7 simultaneously supplies positive sustaining pulses $IP_X$ as shown in FIG. 15 to the row electrodes $X_{k+1}$–$X_n$ which form the display area S2, the lower half screen of the PDP 10. In addition, immediately after the supply of the sustaining pulses $IP_X$, the second sustain driver 8 simultaneously supplies positive sustaining pulses $IP_Y$ as shown in FIG. 15 to the row electrodes $Y_{k+1}$–$Y_n$ which form the display area S2. By the divided light emission sustaining process Ic2, only discharge cells in which a wall charge remains out of the discharge cells belonging to the display area S2, the lower half screen of the PDP 10, generate a sustaining discharge each time the sustaining pulses $IP_Y$ and $IP_X$ are supplied thereto. That is, only discharge cells which had been set to the "light emitting cell" state during said picture element data write process Wc0 of the subfield SF1 generate a sustaining discharge each time the sustaining pulses $IP_Y$ and $IP_X$ are supplied thereto, and emit the pulse light for two frequencies.

After the completion of the divided light emission sustaining process Ic2 of the subfield SF1 and the divided light emission sustaining process Ic1 of the subfield SF2, the driver executes the second picture element data write process Wc2 of the subfield SF2, as shown in FIG. 14.

During the second picture element data write process Wc2, the address driver 6 first extracts picture element driving data bits $DB2_{(k+1)1}$–$DB2_{nm}$ corresponding to the display area S2 out of the picture element driving data bits $DB2_{11}$–$DB2_{nm}$ read from the memory 4. Next, the address driver 6 generates [(n−k)×m] picture element data pulses containing a pulse voltage corresponding to the logical level of each of these picture element driving data bits $DB2_{(k+1)1}$–$DB2_{nm}$. Then the address driver 6 matches the [(n−k)×m] picture element data pulses to each of the (k+1)th to n-th display lines which form the display area S2, groups them into picture element data pulse groups $DP_{k+1}$–$DP_n$ for each display line, and supplies the picture element data pulse groups $DP_{k+1}$–$DP_n$ to the column electrodes $D_1$–$D_m$ sequentially, as shown in FIG. 15. During this time, the second sustain driver 8 generates negative scanning pulses SP at the supply timing of each of the picture element data pulse groups $DP_{k+1}$–$DP_n$, and supplies the pulses to the row electrodes $Y_1$–$Y_k$ sequentially, as shown in FIG. 15. In this case, a selective erasing discharge is generated only in a discharge cell at the intersection of a display line to which the scanning pulses SP are supplied and a "column" to which the picture element data pulses of high voltage are supplied. By the selective erasing discharge, the wall charge which had been formed in the discharge cell disappears, and the discharge cell is shifted to the "non-light emitting cell" state. On the other hand, the selective erasing discharge is not generated in a discharge cell to which the scanning pulses SP are supplied and at the same time low voltage picture element data pulses are also supplied. Thus, the discharge cell is sustained at the same state as immediately before the pulse supply. That is, a discharge cell which is at the "light emitting cell" state immediately before the supply of scanning pulses SP is set to a "light emitting cell" state, and a discharge cell which is at the "non-light emitting cell" state immediately before the supply of the scanning pulses SP is sustained at the "non-light emitting cell" state. In this way, what is called picture element data write is performed.

After the completion of the second picture element data write process Wc2 of the subfield SF2, the driver executes the simultaneous light emission sustaining process Ic0, as shown in FIG. 14.

During the simultaneous light emission sustaining process Ic0, the first sustain driver 7 and the second sustain driver 8 supply positive sustaining pulses $IP_X$ and $IP_Y$ to all the row electrodes $X_1$–$X_n$ and $Y_1$–$Y_n$ alternately and repeatedly, as shown in FIG. 15.

The supply frequency of sustaining pulses to be supplied during the simultaneous light emission sustaining process Ic0 is set so as to correspond to the weight of each subfield SF. For example, when the supply frequency of sustaining pulses to be supplied during the simultaneous light emission sustaining process Ic0 of the subfield SF2 is "4", the frequency of sustaining pulses to be supplied during the simultaneous light emission sustaining process Ic0 of each of the subfields SF3–SF14 is as shown below.

SF3:8
SF4:12
SF5:18
SF6:24
SF7:30
SF8:36
SF9:42
SF10:48
SF11:54
SF12:62
SF13:68
SF14:76

By executing this simultaneous light emission sustaining process Ic0, only discharge cells in which a wall charge had been formed during the first picture element data write process Wc1 and the second picture element data write process Wc2, namely, only "light emitting cells" generate a sustaining discharge each time the sustaining pulses $IP_X$ and $IP_Y$ are supplied, and repeat the pulse light emission by the frequency given above.

After the completion of the simultaneous light emission sustaining process Ic0, the driver executes the first picture element data write process Wc1 of the next subfield SF3, as shown in FIG. 14.

During the first picture element data write process Wc1 of the subfield SF3, the address driver 6 first extracts picture element driving data bits $DB3_{11}$–$DB3_{km}$ corresponding to the display area S1 out of the picture element driving data bits $DB3_{11}$–$DB3_{nm}$ read from the memory 4. Next, the address driver 6 generates (k×m) picture element data pulses containing a pulse voltage corresponding to the logical level of each of these picture element driving data bits $DB3_{11}$–$DB3_{km}$. Then the address driver 6 matches the (k×m) picture element data pulses to each of the 1st to k-th display lines which form the display area S1, groups them into the picture element data pulse groups $DP_1$–$DP_k$ of each display line, and supplies the picture element data pulse groups $DP_1$–$DP_k$ to the column electrodes $D_1$–$D_m$ sequentially, as shown in FIG. 15. During this time, the second sustain driver 8 generates negative scanning pulses SP at the supply timing of each of the picture element data pulse groups $DP_1$–$DP_k$, and supplies the pulses to the row electrodes $Y_1$–$Y_k$ sequentially, as shown in FIG. 15. In this case, a selective erasing discharge is generated only in a discharge cell at the intersection of a display line to which the scanning pulses SP are supplied and a "column" to which picture element data pulses of high voltage are supplied. By the selective erasing discharge, the wall charge that had been formed in the discharge cell disappears, and the discharge cell is shifted to the "non-light emitting cell" state. On the other hand, the selective erasing discharge is not generated in a discharge cell to which the scanning pulses SP are supplied and at the same time low voltage picture element data pulses are also supplied. Thus, the discharge cell is sustained at the same state as immediately before the pulse supply. That is, a discharge cell which is at the "light emitting cell" state immediately before the supply of scanning pulses SP is sustained at the "light emitting cell" state. On the other hand, a discharge cell which is at the "non-light emitting cell" state immediately before the supply of scanning pulses SP is sustained at the "non-light emitting cell" state as it is.

After the completion of the first picture element data write process Wc1 of the subfield SF3, the driver executes the divided light emission sustaining process Ic1 of the subfield SF3, as shown in FIG. 14.

During the divided light emission sustaining process Ic1 of the subfield SF3, first, the first sustain driver 7 simultaneously supplies positive sustaining pulses $IP_X$ as shown in FIG. 15 to the row electrodes $X_1$–$X_k$ which form the display area S1, the upper half of the PDP 10. In addition, immediately after the supply of the sustaining pulses $IP_X$, the second sustain driver 8 simultaneously supplies positive sustaining pulses $IP_Y$ as shown in FIG. 15 to the row electrodes $Y_1$–$Y_k$ which form the display area S1. By the divided light emission sustaining process Ic1, only discharge cells in which a wall charge exists out of the discharge cells belonging to said display area S1, namely, only "light emitting cells" generate a sustaining discharge each time the sustaining pulses $IP_Y$ and $IP_X$ are supplied thereto, and the pulse light is emitted for two frequencies.

As shown in FIG. 15, the driver executes the divided light emission sustaining process Ic1 of the subfield SF3 simultaneously with the divided light emission sustaining process Ic2 of the subfield SF2.

During the divided light emission sustaining process Ic2 of the subfield SF2, first, the first sustain driver 7 simultaneously supplies positive sustaining pulses $IP_X$ as shown in FIG. 15 to the row electrodes $X_{k+1}$–$X_n$ which form the display area S2, the lower half of the PDP 10. Immediately after the supply of the sustaining pulses $IP_X$, the second sustain driver 8 simultaneously supplies positive sustaining pulses $IP_Y$ as shown in FIG. 15 to the row electrodes $Y_{k+1}$–$Y_n$ which form said display area S2. By the divided light emission sustaining process Ic2, only discharge cells in which a wall charge remains out of the discharge cells belonging to the display area S2, the lower half of the PDP 10, generate a sustaining discharge each time the sustaining pulses $IP_Y$ and $IP_X$ are supplied thereto. That is, only discharge cells which had been set to the "light emitting cell" state during said second picture element data write process Wc2 of the subfield SF2 generate the sustaining discharge each time the sustaining pulses $IP_Y$ and $IP_X$ are supplied thereto, and emit the pulse light for two frequencies.

This series of such operations as said first picture element data write process Wc1, divided light emission sustaining process Ic1, second picture element data write process Wc2, simultaneous light emission sustaining process Ic0, and divided light emission sustaining process Ic2 of the subfield SF2 is also executed in the subfields SF3–SF13 in the same manner.

In the last subfield SF14, the divided light emission sustaining process Ic1 and the divided light emission sustaining process Ic2 out of the above-mentioned processes are not executed. In the subfield SF14, as shown in FIG. 14, the erasing process E is executed after the simultaneous light emission sustaining process Ic0 is completed. During the erasing process E, the second sustain driver 8 generates erasing pulses, and supplies them to the row electrodes $Y_1$–$Y_n$ simultaneously. By the supply of the erasing pulses, an erasing discharge is generated in all the discharge cells of the PDP 10, and the wall charge remaining in all the discharge cells disappears. That is, by the erasing discharge, all the discharge cells of the PDP 10 become "non-light emitting cells".

By the above-mentioned driving operation, only discharge cells in which the selective erasing discharge is not generated during the picture element data write process (Wc0, Wc1, Wc2) of each subfield, namely, only "light emitting cells" generate a sustaining discharge by a frequency corresponding to the weight of the subfield during the light emission sustaining process (Ic1, Ic0, Ic2) of the subfield. That is, discharge cells at the "light emitting cell" state emit the pulse light repeatedly by the total frequency of sustaining discharges generated during the divided light emission sustaining process Ic1 or Ic2 and the simultaneous light emission sustaining process Ic0 in each subfield.

In this case, the logical level of each of the first to fourteenth bits of picture element driving data GD shown in FIG. 13 determines each discharge cell to be set to a "light emitting cell" or a "non-light emitting cell" during the picture element data write process (Wc0, Wc1, Wc2) of each of the subfields SF1–SF14. That is, when the bit of picture element driving data GD is logical level "1", as shown by black circles in FIG. 13, a selective erasing discharge is generated during the picture element data write process (Wc0, Wc1, Wc2) of the subfield SF corresponding to the bit digit, and the discharge cell is set to a "non-light emitting cell". On the other hand, when the bit of picture element driving data GD is logical level "0", said selective erasing discharge is not generated during the picture element data write process of the subfield SF corresponding to the bit digit, and the discharge cell maintains its "light emitting cell" state. In short, as shown by white circles in FIG. 13, each discharge cell emits light due to the sustaining discharge by the above-mentioned frequency only during the light emission sustaining process (Ic1, Ic0, Ic2) of the subfield SF corresponding to the bit digit. Then various kinds of intermediate brightness are gradationally represented by the total frequency of sustaining discharges generated during the light emission sustaining process of each of the subfields SF1–SF14.

In this case, the number of bit patterns possible for the 14-bit picture element driving data GD to form is only fifteen, as shown in FIG. 13. Therefore, it becomes possible to express the intermediate brightness in fifteen gradations with the light emission brightness ratio as given below, according to the driving operation by means of the picture element driving data GD comprising fifteen patterns.

{0, 1, 4, 9, 17, 27, 40, 56, 75, 97, 122, 150, 182, 217, 255}

Said picture element data PD can originally represent 256 stages of half tones using eight bits. In order to achieve a brightness display having nearly 256 stages of half tones by said 15-tone driving operation, the multitone processing circuit 33 performs multitone processing.

In the above-mentioned embodiment, the writing of picture element data to a discharge cell belonging to the display area S1, the upper half of the PDP 10, is performed during the first picture element data write process Wc1, and the writing of picture element data in a discharge cell belonging to the display area S2, the lower half of the PDP 10, is performed during the second picture element data write process Wc2. After the first picture element data write process Wc1 is completed, the divided light emission sustaining process Ic1 is executed to cause discharge cells belonging to the display area S1 to generate the first frequency (2 frequencies) of sustaining discharge before the second picture element data write process Wc2 is executed. In this way, charged particles that had been formed by the selective erasing discharge during the first picture element data write process Wc1 and decreased over the course of time are formed again by the sustaining discharge during the divided light emission sustaining process Ic1. As a result, plenty of charged particles remain in the discharge cells belonging to the display area S1 immediately before the simultaneous light emission sustaining process Ic0. Thus, a normal sustaining discharge is generated even though the pulse width of the sustaining pulses $IP_X$ and $IP_Y$ to be supplied during the simultaneous light emission sustaining process Ic0 is narrowed. Therefore, the time required for the simultaneous light emission sustaining process Ic0 can be reduced if the pulse width of the sustaining pulses $IP_X$ and $IP_Y$ is narrowed.

According to the above-mentioned embodiment, immediately before the second picture element data write process Wc2, the divided light emission sustaining process Ic2 of the preceding subfield is performed. In this case, charged particles are formed in each discharge cell due to the sustaining discharge generated during the divided light emission sustaining process Ic2. That is, a plenty of charged particles remain in the discharge cells at the stage immediately before the second picture element data write process Wc2, so a selective erasing discharge is generated properly even though the pulse width of the picture element data pulses and scanning pulses SP to be supplied during the second picture element data write process Wc2 is narrowed. Therefore, the time required for the second picture element data write process Wc2 can be reduced if the width of the picture element data pulses and scanning pulses SP is narrowed.

Accordingly, the number of possible gradations to be displayed increases in proportion to the increase in the number of subfields by utilizing the extra time obtained through shortening the required time.

However, the driving operation shown in FIG. 14 can cause a problem as described below, for example, when there is an image due to the third gradation drive and an image due to the fourth gradation drive shown in FIG. 13 existing in one screen of the PDP 10.

Figures 16A, 16B:
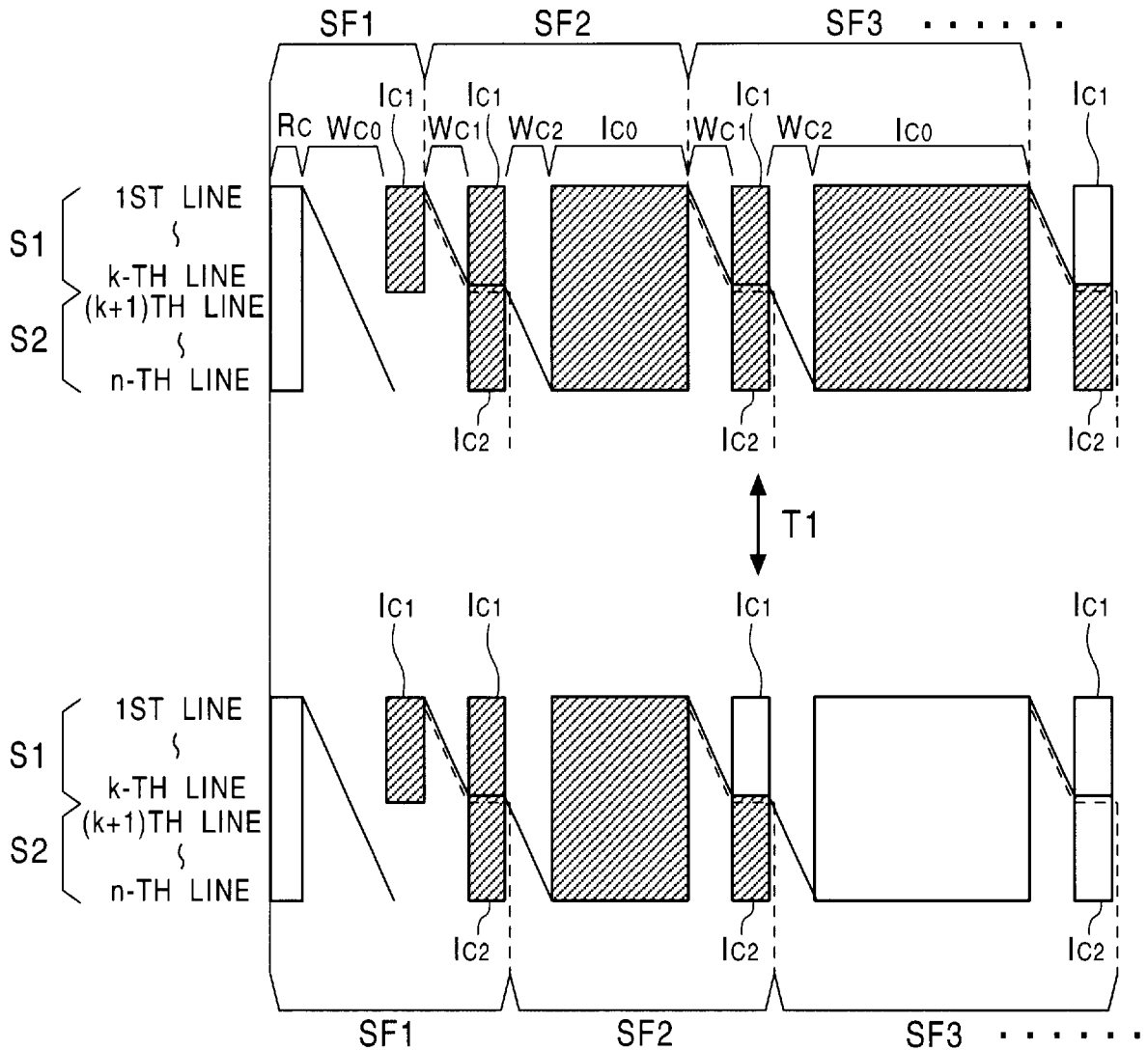
FIGS. 16A and 16B are diagrams showing interblock brightness difference.

In the first place, in the third gradation shown in FIG. 13, as shown by oblique lines in FIG. 16A, the sustaining discharge is generated only during the light emission sustaining process (Ic1, Ic0, Ic2) of each of the subfields SF1–SF3. On the other hand, in the fourth gradation, as shown by oblique lines in FIG. 16B, the sustaining discharge is generated only during the light emission sustaining process (Ic1, Ic0, Ic2) of each of the subfields SF1–SF2. In this case, at point T1 shown by an arrow in FIGS. 16A and 16B, all the discharge cells become the object of sustaining discharge when the fourth gradation drive is performed, as shown in FIG. 16A. On the other hand, when the third gradation drive is performed, as shown in FIG. 16B, only discharge cells of the display area S2 of the PDP 10, namely, only discharge cells of the lower half of the screen become the object of sustaining discharge at said point T1. As a result, at point T1, the amount of discharge current which flows due to the sustaining discharge while the third gradation drive is performed becomes smaller than that while the fourth gradation drive is performed, resulting in a smaller voltage drop in the sustaining pulses IP. Therefore, at point T1, the pulse voltage of sustaining pulses IP to be supplied to the display area S2 in practice when the third gradation drive is performed becomes higher than the pulse voltage of the sustaining pulses IP to be supplied to the display area S2 in practice when the fourth gradation drive is performed. Thereby, at said point T1, the light emission brightness due to the sustaining discharge generated in the display area S2 when the third gradation drive shown in FIG. 16B is performed becomes inevitably higher than the light emission brightness due to sustaining discharge generated in the display area S2 when the fourth gradation drive shown in FIG. 16A is performed.

As a result, it is unavoidable that a brightness difference (interblock brightness difference) occurs between the display areas S1 and S2, if an image formed by said third gradation drive and an image formed by said fourth gradation drive exist in one screen of the PDP 10. Particularly, in subfields having a smaller frequency of sustaining discharge allocated, namely, in the subfields SF1–SF4 having brightness with less weight, said interblock brightness difference becomes notably visible, and deteriorates the display quality.

Figure 17:
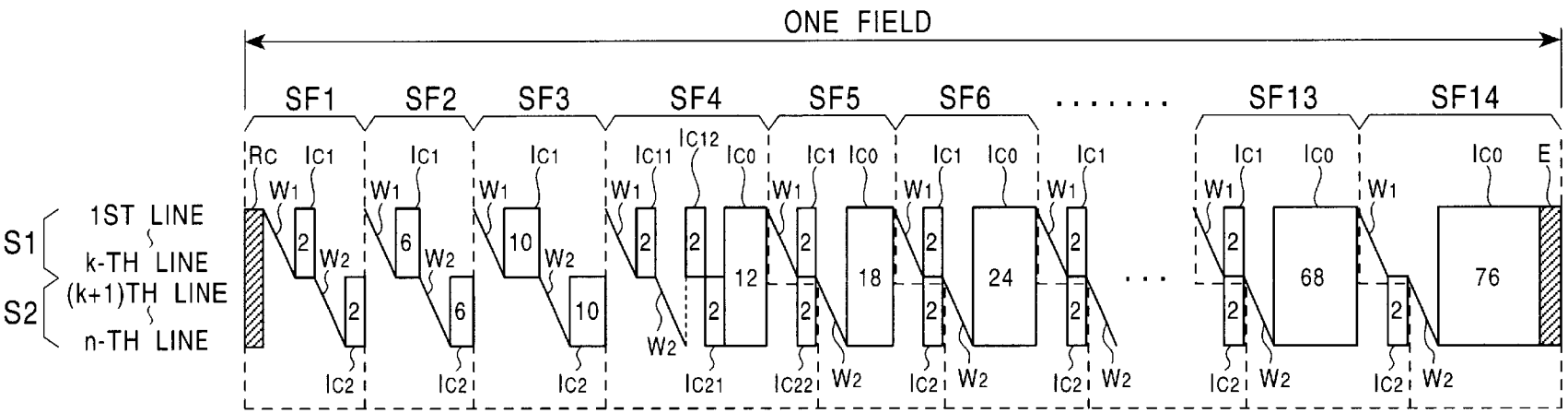
FIG. 17 shows an example of a light emission driving format based on the driving method according to the present invention.

Therefore, the gradation drive for the PDP 10 is performed that adopts the light emission driving format shown in FIG. 17 instead of the light emission driving format shown in FIG. 14.

According to the light emission driving format shown in FIG. 17, the operation in subfields having relatively great weight, namely, in each of the subfields SF5–SF14 in which the sustaining discharge is generated many times during the simultaneous light emission sustaining process Ic0 is the same as the operation shown in FIGS. 14 and 15. Therefore, the description about the driving operation in accordance with the light emission driving format shown in FIG. 17 will be given below laying stress on the operation in subfields having relatively less weight, namely, the operation in each of the subfields SF1–SF4 having less frequency of sustaining discharges allocated.

Figure 18:
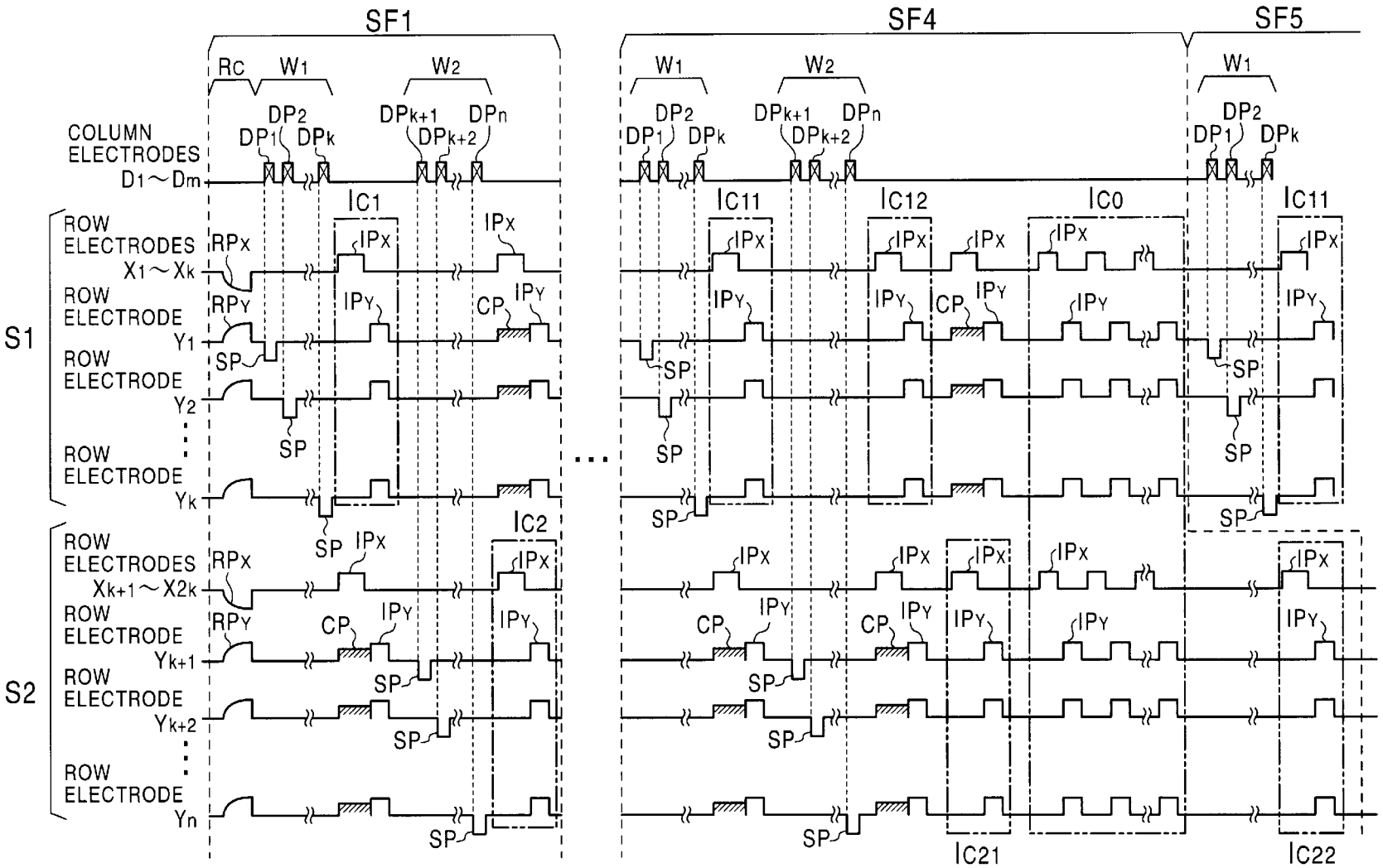
FIG. 18 shows various kinds of driving pulses to be supplied to the column electrodes and the row electrodes of the PDP 10 according to the light emission driving format shown in FIG. 17 and the supply timing thereof.

FIG. 18 is a diagram showing the various kinds of driving pulses to be supplied to the PDP 10 by the driver comprising the address driver 6, the first sustain driver 7, and the second sustain driver 8, and their supply timing when the light emission driving format shown in FIG. 17 is adopted.

In FIG. 18, only subfields SF1 and SF4 are shown being extracted out of the subfields SF1–SF14.

In FIG. 18, during the simultaneous reset process Rc which is performed only in the first subfield SF1, the first sustain driver 7 generates negative reset pulses $RP_X$ as shown in FIG. 18, and supplies the pulses to the row electrodes $X_1$–$X_n$. In addition, during the simultaneous reset process Rc, simultaneously with the supply of said reset pulses $RP_X$, the second sustain driver 8 generates positive reset pulses $RP_Y$, and supplies the pulses to the row electrodes $Y_1$–$Y_n$. In response to the supply of these reset pulses $RP_X$ and $RP_Y$, a reset discharge is generated in all the discharge cells of the PDP 10, and a predetermined amount of wall charge is formed uniformly in each discharge cell. By performing the simultaneous reset process Rc, all the discharge cells of the PDP 10 are initialized to the "light emitting cell" state once.

After the execution of said simultaneous reset process Rc, the driver executes the first picture element data write process Wc1.

During the first picture element data write process Wc1, the address driver 6 first extracts picture element driving data bits $DB1_{11}$–$DB1_{km}$ corresponding to the display area S1 out of the picture element driving data bits $DB1_{11}$–$DB1_{nm}$ read from the memory 4. Next, the address driver 6 generates (k×m) picture element data pulses containing a pulse voltage corresponding to the logical level of each of these picture element driving data bits $DB1_{11}$–$DB1_{km}$. Then the address driver 6 matches the (k×m) picture element data pulses to each of the 1st to k-th display lines which form the display area S1, groups the matched pulses into picture element data pulse groups $DP_1$–$DP_k$ for each display line, and supplies the pulse groups to the column electrodes $D_1$–$D_m$ sequentially, as shown in FIG. 18. During this time, the second sustain driver 8 generates negative scanning pulses SP at the supply timing of each of the picture element data pulse groups $DP_1$–$DP_k$, and supplies the pulses to the row electrodes $Y_1$–$Y_k$ sequentially, as shown in FIG. 18. In this case, a selective erasing discharge is generated only in a discharge cell at the intersection of a display line to which the scanning pulses SP are supplied and a "column" to which high voltage picture element data pulses are supplied. By said selective erasing discharge, the wall charge that had been formed in the discharge cell disappears, and this discharge cell is shifted to the "non-light emitting cell" state. On the other hand, the selective erasing discharge is not generated in a discharge cell to which the scanning pulses SP are supplied and at the same time low voltage picture element data pulses are also supplied. As a result, each discharge cell is sustained at the state initialized during the simultaneous reset process Rc, namely, at the "light emitting cell" state as it is. By the first picture element data write process Wc1, each of the discharge cells belonging to the display area S1, the upper half of the screen, out of the discharge cells of the PDP 10 is set to either the "light emitting cell" state or the "non-light 1 emitting cell" state in accordance with the picture element data PD.

After the execution of the first picture element data write process Wc1, the driver executes the divided light emission sustaining process Ic1.

During the divided light emission sustaining process Ic1, first, the first sustain driver 7 simultaneously supplies positive sustaining pulses $IP_X$ as shown in FIG. 18 to the row electrodes $X_1$–$X_k$ belonging to the display area S1 which forms the upper half of the PDP 10. Immediately after the supply of the sustaining pulses $IP_X$, the second sustain driver 8 simultaneously supplies positive sustaining pulses $IP_Y$ as shown in FIG. 18 to the row electrodes $Y_1$–$Y_k$ belonging to the display area S1 which forms the upper half of the PDP 10. By this divided light emission sustaining process Ic1, only discharge cells in which a wall charge exists out of the discharge cells belonging to the display area S1, namely, only "light emitting cells" generate the sustaining discharge each time the sustaining pulses $IP_Y$ and $IP_X$ are supplied thereto, and the pulse light is emitted for two frequencies.

At the same timing as that of the divided light emission sustaining process Ic1, the first sustain driver 7 simultaneously supplies positive sustaining pulses $IP_X$ as shown in FIG. 18 to the row electrodes $X_{k+1}$–$X_n$ belonging to the display area S2 which forms the lower half of the PDP 10. In addition, simultaneously with the supply of the sustaining pulses $IP_X$, the second sustain driver 8 simultaneously supplies positive and low level canceling pulses CP as shown in FIG. 18 to the row electrodes $Y_{k+1}$–$Y_n$ belonging to the display area S2 which forms the lower half of the PDP 10. Immediately after the supply of the canceling pulses CP, the second sustain driver 8 simultaneously supplies positive sustaining pulses $IP_Y$ as shown in FIG. 18 to the row electrodes $Y_{k+1}$–$Y_n$ belonging to the display area S2. In this case, although the sustaining pulses $IP_X$ and $IP_Y$ are supplied respectively to the row electrodes $X_{k+1}$–$X_n$ and $Y_{k+1}$–$Y_n$ belonging to the display area S2, the sustaining discharge is not generated because the canceling pulses CP of low level are supplied simultaneously with the sustaining pulses $IP_X$.

After the execution of the divided light emission sustaining process Ic1, the driver executes the second picture element data write process Wc2.

During the second picture element data write process Wc2, the address driver 6 first extracts picture element driving data bits $DB1_{(k+1)1}$–$DB1_{nm}$ corresponding to the display area S2 out of the picture element driving data bits $DB1_{11}$–$DB1_{nm}$ read from the memory 4. Next, the address driver 6 generates [(n−k)×m] picture element data pulses containing a pulse voltage corresponding to the logical level of each of these picture element driving data bits $DB1_{(k+1)}$–$DB1_{nm}$. Then the address driver 6 matches the [(n−k)×m] picture element data pulses to each of the (k+1)th to n-th display lines which form the display area S2, groups the matched pulses into picture element data pulse groups $DP_{k+1}$–$DP_n$ by each display line, and supplies the pulse groups to the column electrodes $D_1$–$D_m$ sequentially, as shown in FIG. 18. During this time, the second sustain driver 8 generates negative scanning pulses SP at the supply timing of each of the picture element data pulse groups $DP_{k+1}$–$DP_n$, and supplies the pulses to the row electrodes $Y_1$–$Y_k$ sequentially, as shown in FIG. 18. In this case, a selective erasing discharge is generated only in a discharge cell at the intersection of a display line to which the scanning pulses SP are supplied and a "column" to which high voltage picture element data pulses are supplied. By said selective erasing discharge, the wall charge that had been formed in the discharge cell disappears, and this discharge cell is shifted to the "non-light emitting cell" state. On the other hand, the above-mentioned selective erasing discharge is not generated in a discharge cell to which the scanning pulses SP are supplied and at the same time low voltage picture element data pulses are also supplied. As a result, in this case, each discharge cell is sustained at the state initialized during the simultaneous reset process Rc, namely, at the "light emitting cell" state as it is. By the second picture element data write process Wc2, each discharge cell belonging to the display area S2, the lower half of the screen, out of the discharge cells of the PDP 10 is set to either the "light emitting cell" state or the "non-light emitting cell" state in accordance with the picture element data PD.

After the completion of said second picture element data write process Wc2, the driver executes the divided light emission sustaining process Ic2.

During the divided light emission sustaining process Ic2, first, the first sustain driver 7 simultaneously supplies positive sustaining pulses $IP_X$ as shown in FIG. 18 to the row electrodes $X_{k+1}$–$X_n$ which form the display area S2, the lower half of the PDP 10. Immediately after the supply of the sustaining pulses $IP_X$, the second sustain driver 8 simultaneously supplies positive sustaining pulses $IP_Y$ as shown in FIG. 18 to the row electrodes $Y_{k+1}$–$Y_n$ which form the display area S2. By the divided light emission sustaining process Ic2, the sustaining discharge is generated only in discharge cells in which a wall charge remains out of the discharge cells belonging to the display area S2, the lower half of the PDP, each time the sustaining pulses $IP_Y$ and $IP_X$ are supplied. That is, only discharge cells that had been set to the "light emitting cell" state during said second picture element data write process Wc2 generate the sustaining discharge each time sustaining pulses $IP_Y$ and $IP_X$ are supplied, and emit the pulse light for two frequencies.

At the same timing as that of the divided light emission sustaining process Ic2, the first sustain driver 7 simultaneously supplies positive sustaining pulses $IP_X$ as shown in FIG. 18 to the row electrodes $X_1$–$X_k$ belonging to the display area S1 which forms the upper half of the PDP 10. In addition, simultaneously with the supply of the sustaining pulses $IP_X$, the second sustain driver 8 simultaneously supplies positive and low level canceling pulses CP as shown in FIG. 18 to the row electrodes $Y_1$–$Y_k$ belonging to the display area S1. Immediately after the supply of the canceling pulses CP, the second sustain driver 8 simultaneously supplies positive sustaining pulses $IP_Y$ as shown in FIG. 18 to the row electrodes $Y_1$–$Y_k$ belonging to the display area S1. In this case, although the sustaining pulses $IP_X$ and $IP_Y$ are supplied respectively to the row electrodes $X_1$–$X_k$ and $Y_1$–$Y_k$ belonging to the display area S1, the sustaining discharge is not generated because the canceling pulses CP of low level are also supplied simultaneously with the sustaining pulses $IP_X$.

After the completion of the divided light emission sustaining process Ic2 of the subfield SF1, the driver executes the operation in each of the subfields SF2–SF4, as shown in FIG. 17.

In this case, in the subfields SF2 and SF3, the driver executes the first picture element data write process Wc1, the divided light emission sustaining process Ic1, the second picture element data write process Wc2, and the divided light emission sustaining process Ic2 sequentially as it does in the subfield SF1.

When the supply frequency of the sustaining pulses IP to be supplied during the divided light emission sustaining process Ic2 of the subfield SF1 is "2", the supply frequency of sustaining pulses IP to be supplied during the divided light emission sustaining process Ic1 (or the divided light emission sustaining process Ic2) of the subfields SF2 and SF3 is as follows, as shown in FIG. 17.

SF1:2

SF2:6

SF3:10

In the subfield SF4, the driver executes said first picture element data write processes Wc1 and Wc2 as it does in each of the subfields SF1–SF3. However, in the subfield SF4, the sustaining discharge generated during the divided light emission sustaining process Ic1 is executed as two separated processes, the first divided light emission sustaining process Ic11 and the second divided light emission sustaining process Ic12, as is shown in FIG. 17. In addition, in the subfield SF4, the sustaining discharge generated during the divided light emission sustaining process Ic2 is executed as two separated processes, the first divided light emission sustaining process Ic21 and the second divided light emission sustaining process Ic22, as shown in FIG. 17.

That is, the driver executes the first picture element data write process Wc1 first, and immediately after that, executes the first divided light emission sustaining process Ic11 in the subfield SF4.

During the first divided light emission sustaining process Ic11, the first sustain driver 7 simultaneously supplies positive sustaining pulses $IP_X$ as shown in FIG. 18 to the row electrodes $X_1$–$X_k$ belonging to the display area S1 which forms the upper half of the PDP 10. Immediately after the supply of the sustaining pulses $IP_X$, the second sustain driver 8 simultaneously supplies positive sustaining pulses $IP_Y$ as shown in FIG. 18 to the row electrodes $Y_1$–$Y_k$ belonging to the display area S1 which forms the upper half of the PDP 10. By this first divided light emission sustaining process Ic11, the sustaining discharge is generated only in discharge cells in which a wall charge exists out of the discharge cells belonging to the display area S1, that is, only "light emitting cells" generate the sustaining discharge each time the sustaining pulses $IP_Y$ and $IP_X$ are supplied, and the pulse light is emitted for two frequencies.

After the execution of the first divided light emission sustaining process Ic11, the driver executes said second picture element data write process Wc2, and executes the second divided light emission sustaining process Ic12 after the second picture element data write process Wc2 is completed.

During the second divided light emission sustaining process Ic12, the first sustain driver 7 simultaneously supplies positive sustaining pulses $IP_X$ as shown in FIG. 18 to the row electrodes $X_1$–$X_k$ belonging to the display area S1 which forms the upper half of the PDP 10. Immediately after the supply of the sustaining pulses $IP_X$, the second sustain driver 8 simultaneously supplies positive sustaining pulses $IP_Y$ as shown in FIG. 18 to the row electrodes $Y_1$–$Y_k$ belonging to the display area S1 which forms the upper half of the PDP 10. By the second divided light emission sustaining process Ic12, the sustaining discharge is generated only in discharge cells in which a wall charge exists out of the discharge cells belonging to the display area S1, that is, only "light emitting cells" generate the sustaining discharge each time the sustaining pulses $IP_Y$ and $IP_X$ are supplied, and the pulse light is emitted for two frequencies.

After the completion of the second divided light emission sustaining process Ic12, the driver executes the first divided light emission sustaining process Ic21.

During the first divided light emission sustaining process Ic21, first, the first sustain driver 7 simultaneously supplies positive sustaining pulses $IP_X$ as shown in FIG. 18 to the row electrodes $X_{k+1}$–$X_n$ which form the display area S2, the lower half of the PDP 10. Immediately after the supply of the sustaining pulses $IP_X$, the second sustain driver 8 simultaneously supplies positive sustaining pulses $IP_Y$ as shown in FIG. 18 to the row electrodes $Y_{k+1}$–$Y_n$ which form the display area S2. By executing the divided light emission sustaining process Ic2, the sustaining discharge is generated only in discharge cells in which a wall charge remains out of the discharge cells belonging to the display area S2, the lower half of the PDP 10, each time the sustaining pulses $IP_Y$ and $IP_X$ are supplied. That is, only discharge cells that had been set to the "light emitting cell" state during said second picture element data write process Wc2 generate the sustaining discharge each time the sustaining pulses $IP_Y$ and $IP_X$ are supplied, and emit the pulse light for two frequencies.

In the subfield SF4, as shown in FIG. 17, the driver executes the simultaneous light emission sustaining process Ic0 after the first divided light emission sustaining process Ic21 is completed.

During the simultaneous light emission sustaining process Ic0, the first sustain driver 7 and the second sustain driver 8 supply positive sustaining pulses $IP_X$ and $IP_Y$ to all the row electrodes $X_1$–$X_n$ and $Y_1$–$Y_n$ alternately and repeatedly, as shown in FIG. 18. The supply frequency (supply period) of the sustaining pulses to be supplied during the simultaneous light emission sustaining process Ic0 is "12" in the subfield SF4. As a result, by executing the simultaneous light emission sustaining process Ic0, only discharge cells in which a wall charge had been formed during the first picture element data write process Wc1 and the second picture element data write process Wc2, namely, only "light emitting cells" generate the sustaining discharge each time the sustaining pulses $IP_X$ and $IP_Y$ are supplied, and repeat the pulse light emission by said frequency.

After the completion of the simultaneous light emission sustaining process Ic0, the driver executes the first picture element data write process Wc1 of the next subfield SF5, as shown in FIG. 17. After the completion of the first picture element data write process Wc1 of the subfield SF5, the driver executes the second divided light emission sustaining process Ic22 of the subfield SF4.

During the second divided light emission sustaining process Ic22, first, the first sustain driver 7 simultaneously supplies positive sustaining pulses $IP_X$ as shown in FIG. 18 to the row electrodes $X_{k+1}$–$X_n$ which form the display area S2, the lower half of the PDP 10. Immediately after the supply of the sustaining pulses $IP_X$, the second sustain driver 8 simultaneously supplies positive sustaining pulses $IP_Y$ as shown in FIG. 18 to the row electrodes $Y_{k+1}$–$Y_n$ which form the display area S2. By executing the divided light emission sustaining process Ic2, the sustaining discharge is generated only in discharge cells in which a wall charge remains out of the discharge cells belonging to the display area S2, the lower half of the PDP 10, each time the sustaining pulses $IP_Y$ and $IP_X$ are supplied. That is, only discharge cells that had been set to the "light emitting cell" state during the second picture element data write process Wc2 of the subfield SF4 as described above generate the sustaining discharge each time the sustaining pulses $IP_Y$ and $IP_X$ are supplied, and emit the pulse light for two frequencies.

By the driving operation shown in FIG. 17, only discharge cells that had been set to the "light emitting cell" state during the picture element data write process (Wc1, Wc2) of each subfield generate the sustaining discharge by a frequency corresponding to the weight of the subfield during the light emission sustaining process (Ic1, Ic2, Ic11, Ic12, Ic21, Ic22, Ic0) of the subfield. That is, discharge cells at the "light emitting cell" state, as shown in FIG. 19, emit the pulse light by the total frequency of sustaining discharge generated during each light emission sustaining process (Ic1, Ic2, Ic11, Ic12, Ic21, Ic22, Ic0) of each subfield SF.

In the driving operation shown in FIG. 17, like the operation shown in FIG. 14, the gradation of the PDP 10 is driven by means of the 15-pattern picture element driving data GD shown in FIG. 13. As a result, by the driving operation by means of picture element driving data GD comprising fifteen patterns, it becomes possible to display the intermediate brightness in fifteen gradations, each having the light emission brightness ratio given below, similarly to the driving operation shown in FIG. 14.

{0, 1, 4, 9, 17, 27, 40, 56, 75, 97, 122, 150, 182, 217, 255}

In this case, by the driving operation shown in FIG. 17, the divided light emission sustaining process (Ic1, Ic2) is executed for the display areas S1 and S2 immediately after the picture element data write process (Wc1, Wc2) is completed in the subfields SF1–SF3 having less weight, namely, having less frequency of sustaining discharge allocated. Thus, according to said driving operation, the execution time of the divided light emission sustaining process Ic1 corresponding to the display area S1 and that of the divided light emission sustaining process Ic2 corresponding to the display area S2 do not overlap each other.

Therefore, said driving operation can prevent the interblock brightness difference which is visible during the low brightness display by, for example, the above-mentioned third gradation drive or by the fourth gradation drive.

Figure 20A:
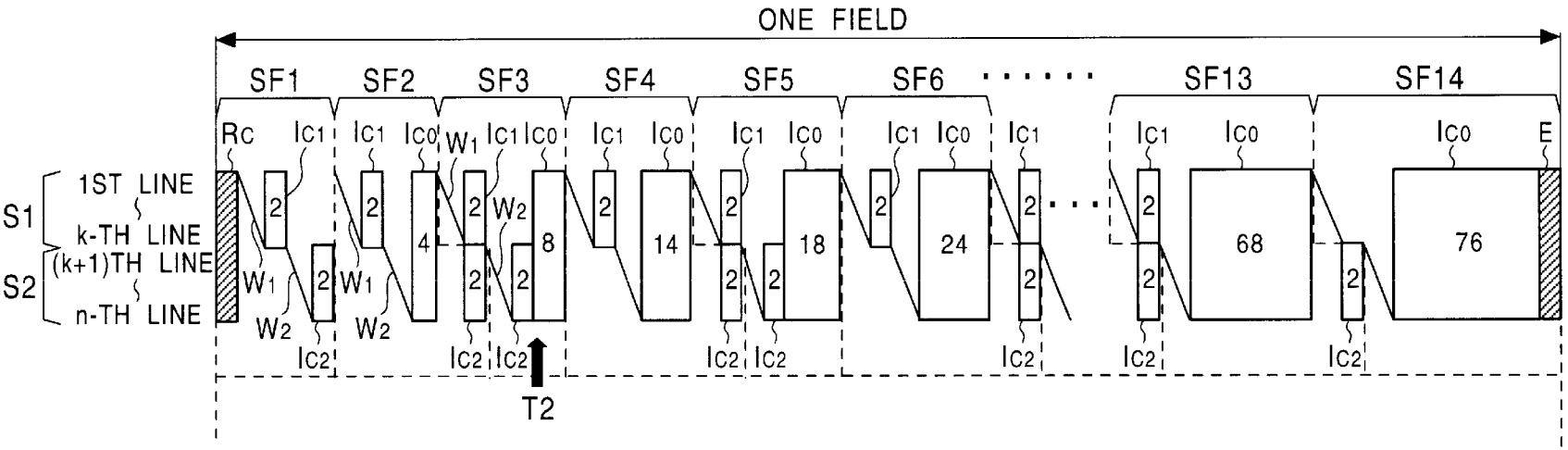
FIGS. 20A and 20B are diagrams showing an example of the light emission driving format based on other driving method according to the present invention.
Figure 20B:
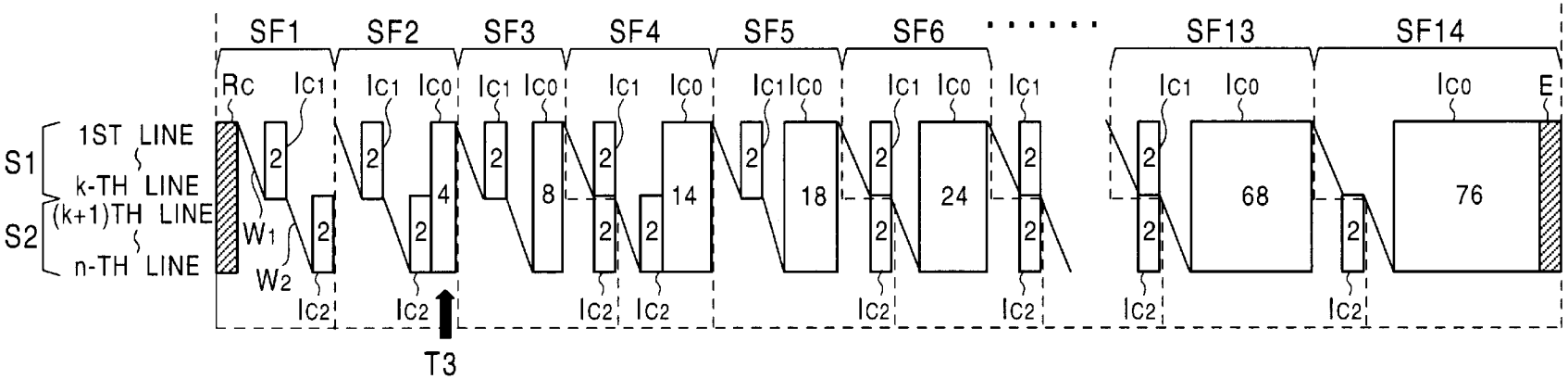

The gradation of the PDP 10 may be driven by switching to the first light emission driving format shown in FIG. 20A and the second light emission driving format shown in FIG. 20B for each display period of one field (or one frame), instead of the light emission driving format shown in FIG. 17. In this case, according to the first light emission driving format shown in FIG. 20A, the driving operation in the subfields SF2 and SF4 and in the subfields SF6–SF14 is the same as that shown in FIG. 14, and the driving operation performed in the first subfield SF1 is the same as that shown in FIG. 17, so a description will be given of the driving operation in the subfields other than the subfields SF1, SF2, SF4, and SF6–SF14, namely, the driving operation in the subfields SF3 and SF5 only.

In the subfields SF3 and SF5 shown in 20A, the driver first executes the above-mentioned first picture element data write process Wc1, and immediately after that process is completed, it executes the divided light emission sustaining process Ic1 to cause "light emitting cells" belonging to the display area S1 to generate the sustaining discharge for two frequencies. After the completion of the divided light emission sustaining process Ic1, the driver executes the divided light emission sustaining process Ic2 to cause "light emitting cells" belonging to the display area S2 to generate the sustaining discharge for two frequencies. After the completion of the divided light emission sustaining process Ic2, the driver executes the simultaneous light emission sustaining process Ic0 to cause all the "light emitting cells" to generate the sustaining discharge simultaneously and repeatedly. In this case, the sustaining discharge is generated "8" frequencies during the simultaneous light emission sustaining process Ic0 of the subfield SF3, and "8" frequencies during the simultaneous light emission sustaining process Ic0 of the subfield SF5.

According to the first light emission driving format shown in FIG. 20A, the interblock brightness difference is visible between the display areas S1 and S2 due to the above-mentioned reasons in the subfields SF2 and SF4. That is, in the subfields SF2 and SF4, the display area S1 appears to be dark, and the display area S2 appears to be bright. On the other hand, in the subfields SF3 and SF5, the display area S1 looks bright, and the display area S2 looks dark. This phenomenon is caused by too short an interval between the divided light emission sustaining process Ic2 for the display area S2 and the simultaneous light emission sustaining process Ic0 in the subfields SF3 and SF5, as shown in FIG. 20A. For example, in the display area S2 in the subfield SF3, the sustaining discharge in each discharge cell is generated centering at point T2 shown in FIG. 20A, so the discharge current increases. As a result, the voltage drop in sustaining pulses IP to be supplied to the discharge cells belonging to the display area S2 increases in proportion to the increase in the discharge current. Therefore, the light emission brightness due to the sustaining discharge falls more in the display area S2 than in the display area S1 because of the pulse voltage drop in the sustaining pulses IP.

On the other hand, according to the second light emission driving format shown in FIG. 20B, the above-mentioned first picture element data write process Wc1 is executed first in the subfields SF2 and SF4, and immediately after the completion of the process Wc1, the driver executes the divided light emission sustaining process Ic1 to cause "light emitting cells" belonging to the display area S1 to generate the sustaining discharge for two frequencies. After the completion of the divided light emission sustaining process Ic1, the driver executes the divided light emission sustaining process Ic2 to cause "light emitting cells" belonging to the display area S2 to generate the sustaining discharge for two frequencies. After the completion of the divided light emission sustaining process Ic2, the driver executes the simultaneous light emission sustaining process Ic0 to cause all the "light emitting cells" to generate the sustaining discharge simultaneously and repeatedly. In this case, the sustaining discharge is generated "4" frequencies during the simultaneous light emission sustaining process Ic0 of the subfield SF2, and "14" frequencies during the simultaneous light emission sustaining process Ic0 of the subfield SF4.

According to said second light emission driving format, the operation performed in the subfields SF3 and SF5–SF14 is the same as that shown in FIG. 14, and the operation performed in the first subfield SF1 is the same as that shown in FIG. 17.

That is, according to the second light emission driving format shown in FIG. 20B, the interblock brightness difference between the display areas S1 and S2 is visible due to the above-mentioned reasons in the subfields SF3 and SF5. In other words, in the subfields SF3 and SF5, the display area S1 appears to be dark, and the display area S2 appears to be bright. In the subfields SF2 and SF4, the display area S1 looks bright, and the display area S2 looks dark. This phenomenon is caused by too short an interval between the divided light emission sustaining process Ic2 and the simultaneous light emission sustaining process Ic0 for the display area S2 in the subfields SF2 and SF4, as is shown in FIG. 20B. For example, in the display area S2 in the subfield SF2, the sustaining discharge in each discharge cell is generated centering at point T3 shown in FIG. 20B, so the discharge current increases. As a result, the voltage drop in sustaining pulses IP to be supplied to the discharge cells belonging to the display area S2 increases in proportion to the increase in the discharge current. Therefore, the light emission brightness due to the sustaining discharge falls more in the display area S2 than in the display area S1 because of the pulse voltage drop in the sustaining pulses IP.

Figure 21A:
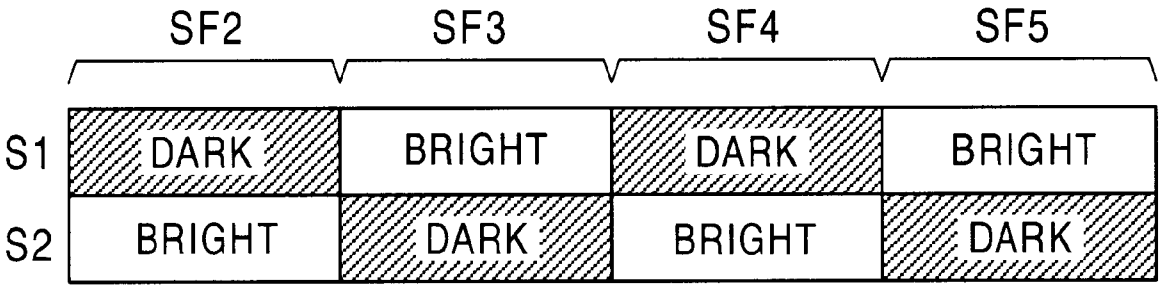
FIGS. 21A and 21B are diagrams showing a light emission state of subfields SF2–SF5 based on the drive shown in FIGS. 20A and 20B.

As described above, according to the first light emission driving format shown in FIG. 20A, the display area S1 appears to be dark, and the display area S2 appears to be bright in the subfields SF2 and SF4, as is shown in FIG. 21A. In the subfields SF3 and SF5, the display area S1 appears to be bright and the display area S2 appears to be dark. On the other hand, according to the first light emission driving format shown in FIG. 20B, the display area S1 looks being bright, and the display area S2 looks dark in the subfields SF2 and SF4, and in the subfields SF3 and SF5, the display area S1 looks dark and the display area S2 looks bright, as is shown in FIG. 21B.

Figure 21B:
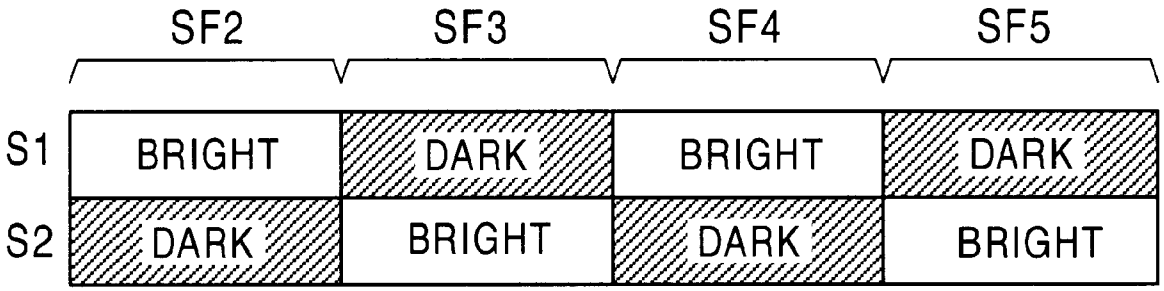

That is, as shown in FIGS. 21A and 21B, in the subfields SF2–SF5 having relatively less weight, the relative level of brightness between the display areas S1 and S2 is reversed by the first light emission driving format and by the second light emission driving format. Therefore, the interblock brightness difference between the display areas S1 and S2 is reduced if the gradation of the PDP 10 is driven by switching between both formats for each display period of one field.

Figure 22:
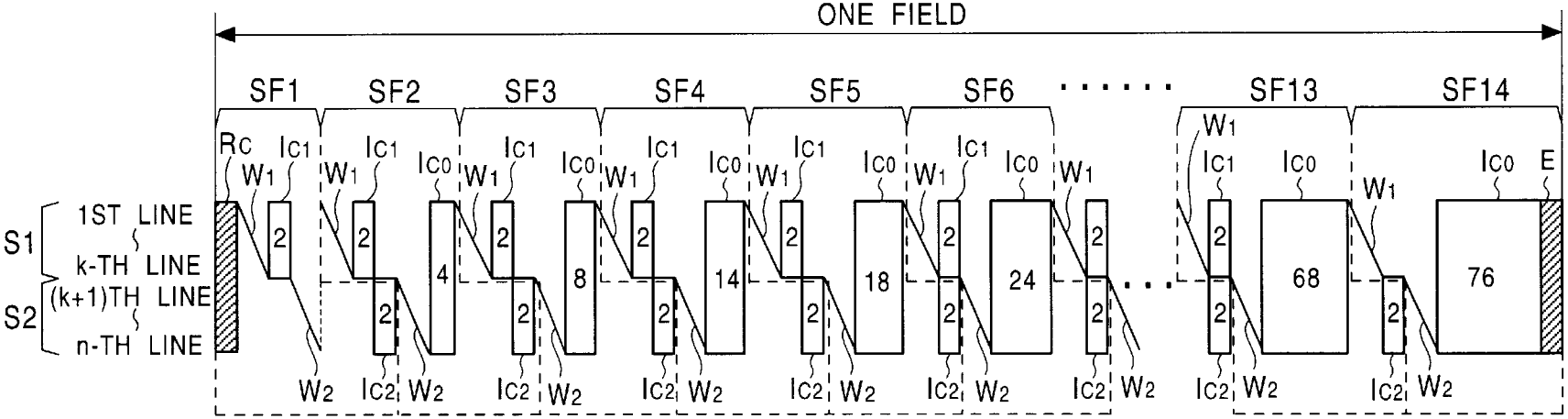
FIG. 22 is diagram showing an example of a light emission driving format based on another driving method according to the present invention.

Another possible way to reduce the interblock brightness difference which notably appears in subfields having less weight is to adopt the light emission driving format shown in FIG. 22 instead of the light emission driving format shown in FIG. 14. The operation according to the light emission driving format shown in FIG. 22 in each of the subfields SF5–SF14 is the same as that according to the light emission driving format shown in FIG. 14, so a description it is omitted.

According to the light emission driving format shown in FIG. 22, in each of the subfields SF1–SF4 having less weight, the first picture element data write process Wc1, the divided light emission sustaining process Ic1, the second picture element data write process Wc2, and the divided light emission sustaining process Ic2 are executed as they are in each of the subfields SF5–SF14. In addition, in the subfields SF2–SF4, the simultaneous light emission sustaining process Ic0 is executed immediately after the second picture element data write process Wc2 in the same manner as in the case of the subfields SF5–SF14.

However, the divided light emission sustaining process Ic2 of the subfields SF2–SF4 is not executed simultaneously with the divided light emission sustaining process Ic1 of the next subfield, but is executed after said divided light emission sustaining process Ic1 is completed. That is, as shown in FIG. 22, in the subfields SF2–SF4, after the completion of the divided light emission sustaining process Ic1, the divided light emission sustaining process Ic2 of the preceding subfield is executed immediately before the execution of the second picture element data write process Wc2.

Figure 23:
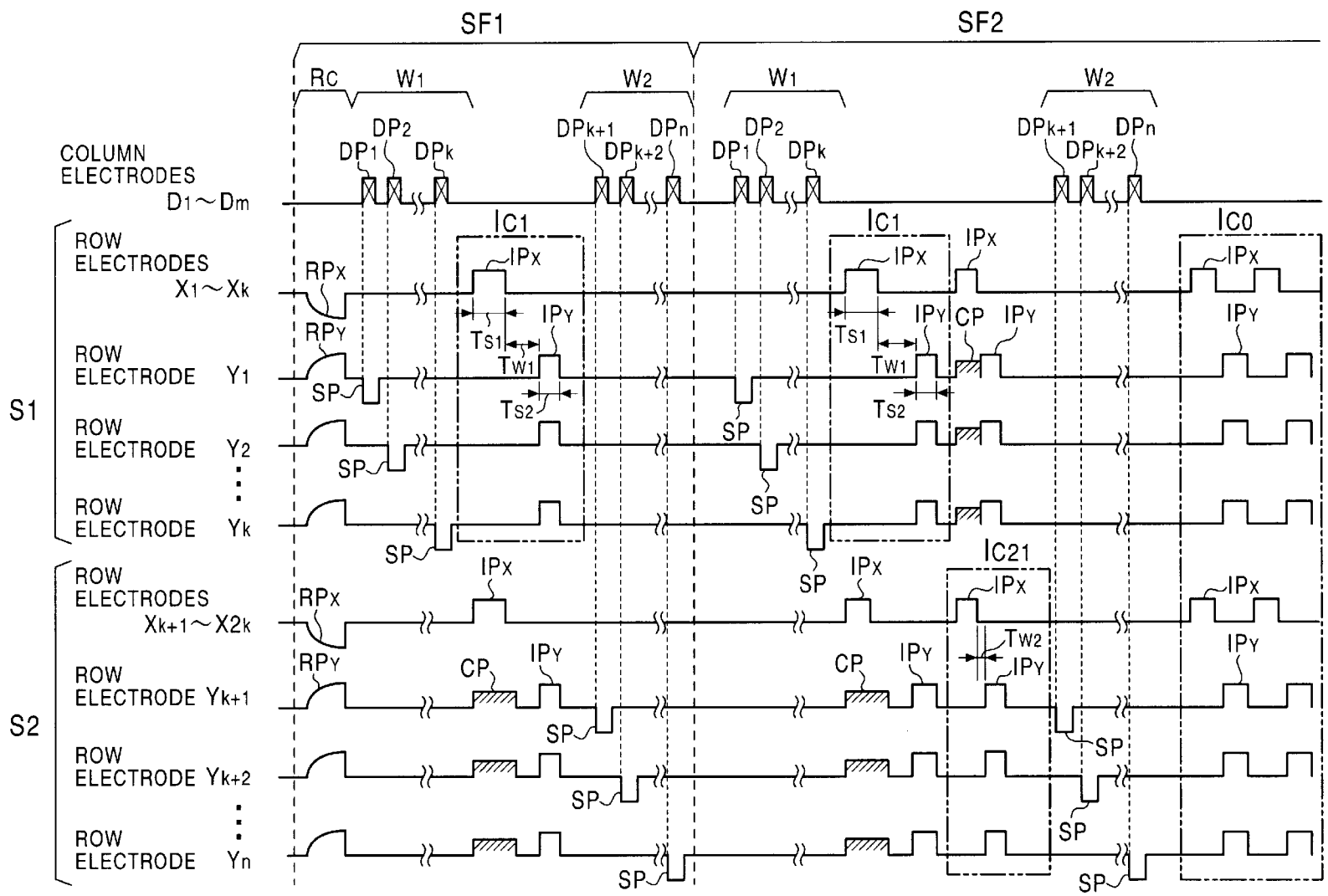
FIG. 23 is a diagram showing various kinds of driving pulses to be supplied to the column electrodes and the row electrodes of the PDP 10 in accordance with the light emission driving format shown in FIG. 22 and their supply timing.

FIG. 23 shows the various kinds of driving pulses to be supplied to the PDP 10 in accordance with the light emission driving format shown in FIG. 22 by the address driver 6, the first sustain driver 7 and the second sustain driver 8, and their supply timing. In FIG. 23, the operation performed only in the subfields SF1 and SF2 is extracted and shown.

In FIG. 23, first, during the simultaneous reset process Rc which is performed only in the first subfield SF1, the first sustain driver 7 generates negative reset pulses $RP_X$, and supplies the pulses to the row electrodes $X_1$–$X_n$. In addition, during the simultaneous reset process Rc, simultaneously with the supply of the reset pulses $RP_X$, the second sustain driver 8 generates positive reset pulses $RP_Y$, and supplies the pulses to the row electrodes $Y_1$–$Y_n$. In response to the supply of these reset pulses $RP_X$ and $RP_Y$, a reset discharge is generated in all the discharge cells in the PDP 10, and a predetermined amount of wall charge is formed uniformly in each discharge cell. By performing said simultaneous reset process Rc, all the discharge cells in the PDP 10 are initialized to the "light emitting cell" state once.

After the execution of the simultaneous reset process Rc, the driver executes the first picture element data write process Wc1, as shown in FIG. 22.

During the first picture element data write process Wc1, the address driver 6 first extracts picture element driving data bits $DB1_{11}$–$DB1_{nm}$ corresponding to the display area S1 out of bits $DB1_{11}$–$DB1_{nm}$ read from the memory 4. Next, the address driver 6 generates (k×m) picture element data pulses having a pulse voltage corresponding to the logical level of each of the picture element driving data bits $DB1_{11}$–$DB1_{nm}$. Then the address driver 6 matches these (k×m) picture element data pulses to each of the 1st to k-th display lines which form the display area S1, groups them into picture element data pulse groups $DP_1$–$DP_k$ for each display line, and supplies the pulse groups to the column electrodes $D_1$–$D_m$ sequentially, as shown in FIG. 23. During this time, the second sustain driver 8 generates negative scanning pulses SP at the supply timing of each of the picture element data pulse groups $DP_1$–$DP_k$, and supplies the pulses to the row electrodes $Y_1$–$Y_k$ sequentially, as shown in FIG. 23. In this case, a selective erasing discharge is generated only in a discharge cell at the intersection of a display line to which the scanning pulses SP are supplied and a "column" to which high voltage picture element data pulses are supplied. By the selective erasing discharge, the wall charge that had been formed in the discharge cell disappears, and the discharge cell is shifted to the "non-light emitting cell" state. On the other hand, the above-mentioned selective erasing discharge is not generated in a discharge cell to which the scanning pulses SP are supplied and at the same time low voltage picture element data pulses are also supplied. As a result, each discharge cell is sustained at the state initialized during the simultaneous reset process Rc, namely, at the "light emitting cell" state as it is. By the first picture element data write process Wc1, each discharge cell belonging to the display area S1, the upper half of the screen, out of the discharge cells in the PDP 10 is set to either the "light emitting cell" state or the "non-light emitting cell" state corresponding to the picture element data PD.

After the execution of the first picture element data write process Wc1, the driver executes the divided light emission sustaining process Ic1, as shown in FIG. 22.

During the divided light emission sustaining process Ic1, first, the first sustain driver 7 simultaneously supplies positive sustaining pulses $IP_X$ as shown in FIG. 23 to the row electrodes $X_1$–$X_k$ belonging to the display area S1 which forms the upper half of the PDP 10. Immediately after the supply of said sustaining pulses $IP_X$1 the second sustain driver 8 simultaneously supplies the positive sustaining pulses $IP_Y$ as shown in FIG. 23 to the row electrodes $Y_1$–$Y_k$ belonging to the display area S1 which forms the upper half of the PDP 10. In this case, the pulse width $T_{S1}$ of the sustaining pulses $IP_X$ to be supplied first during the divided light emission sustaining process Ic1 is set wider than the pulse width $T_{S2}$ of the sustaining pulses $IP_Y$ to be supplied secondarily. By performing said divided light emission sustaining process Ic1, only a discharge cell in which a wall charge exists out of the discharge cells belonging to the display area S1, namely, only a "light emitting cell" generates the sustaining discharge each time the sustaining pulses $IP_Y$ and $IP_X$ are supplied, and the pulse light is emitted for two frequencies.

At the same timing as that of the divided light emission sustaining process Ic1, the first sustain driver 7 simultaneously supplies positive sustaining pulses $IP_X$ as shown in FIG. 23 to the row electrodes $X_{k+1}$–$X_n$ belonging to the display area S2 which forms the lower half of the PDP 10. In addition, simultaneously with the supply of the sustaining pulses $IP_X$, the second sustain driver 8 simultaneously supplies positive and low level canceling pulses CP as shown in FIG. 23 to the row electrodes $Y_{k+1}$–$Y_n$ belonging to the display area S2 which forms the lower half of the PDP 10. Immediately after the supply of the canceling pulses CP, the second sustain driver 8 simultaneously supplies positive sustaining pulses $IP_Y$ as shown in FIG. 23 to the row electrodes $Y_{k+1}$–$Y_n$ belonging to the display area S2. In this case, although the sustaining pulses $IP_X$ and $IP_Y$ are respectively supplied to the row electrodes $X_{k+1}$–$X_n$ and $Y_{k+1}$–$Y_n$ belonging to the display area S2, the sustaining discharge is not generated because the low level canceling pulses CP are supplied thereto simultaneously with the sustaining pulses $IP_X$.

After the execution of the divided light emission sustaining process Ic1, the driver executes the second picture element data write process Wc2, as shown in FIG. 22.

During the second picture element data write process Wc2, first, the address driver 6 extracts picture element driving data bits $DB1_{(k+1)1}$–$DB1_{nm}$ corresponding to the display area S2 out of the bits $DB1_{11}$–$DB1_{nm}$ read from the memory 4. Next, the address driver 6 generates [(n−k)×m] picture element data pulses containing a pulse voltage corresponding to the logical level of each of the picture element driving data bits $DB1_{(k+1)1}$–$DB1_{nm}$. Then the address driver 6 matches these [(n−k)×m] picture element data pulses to each of the (k+1)th to n-th display lines which form the display area S2, groups them into picture element data pulse groups $DP_{k+1}$–$DP_n$ for each display line, and supplies the pulse groups to the column electrodes $D_1$–$D_m$ sequentially, as shown in FIG. 23. During this time, the second sustain driver 8 generates negative scanning pulses SP at the supply timing of each of the picture element data pulse groups $DP_{k+1}$–$DP_n$, and supplies the pulses to the row electrodes $Y_1$–$Y_k$ sequentially, as shown in FIG. 23. In this case, a selective erasing discharge is generated only in a discharge cell at the intersection of a display line to which the scanning pulses SP are supplied and a "column" to which high voltage picture element data pulses are supplied. By said selective erasing discharge, the wall charge that had been formed in the discharge cell disappears, and the discharge cell is shifted to the "non-light emitting cell" state. On the other hand, said selective erasing discharge is not generated in a discharge cell to which the scanning pulses SP are supplied and at the same time low voltage picture element data pulses are also supplied. As a result, each discharge cell is sustained at the state initialized during the simultaneous reset process Rc, namely, at the "light emitting cell" state as it is. By the second picture element data write process Wc2, each discharge cell belonging to the display area S2, the lower half of the PDP 10, out of the discharge cells in the PDP 10 is set to either the "light emitting cell" state or the "non-light emitting cell" state in accordance with the picture element data PD.

After the completion of the second picture element data write process Wc2, the driver executes the first picture element data write process Wc1 of the subfield SF2, as shown in FIG. 22.

During the first picture element data write process Wc1 of the subfield SF2, the address driver 6 first extracts picture element driving data bits $DB2_{11}$–$DB2_{km}$ corresponding to the display area S1 of the $DB2_{11}$–$DB2_{nm}$ read from the memory 4. Next, the address driver 6 generates (k×m)

picture element data pulses having a pulse voltage corresponding to the logical level of each of the picture element driving data bits $DB2_{11}$–$DB2_{nm}$. Then the address driver 6 matches these (k×m) picture element data pulses to each of the 1st to k-th display lines which are responsible for the display area S1, groups the matched pulses into picture element data pulse groups $DP_1$–$DP_k$ for each display line, and supplies the pulse groups to the column electrodes $D_1$–$D_m$ sequentially, as shown in FIG. 23. During this time, the second sustain driver 8 generates negative scanning pulses SP at the supply timing of each of said picture element data pulse groups $DP_1$–$DP_k$, and supplies the pulses to the row electrodes $Y_1$–$Y_k$ sequentially, as shown in FIG. 23. In this case, a selective erasing discharge is generated only in a discharge cell at the intersection of a display line to which the scanning pulses SP are supplied and a "column" to which high voltage picture element data pulses are supplied. By the selective erasing discharge, the wall charge that had been formed in the discharge cell disappears, and the discharge cell is shifted to the "non-light emitting cell" state. On the other hand, said selective erasing discharge is not generated in a discharge cell to which the scanning pulses SP are supplied and at the same time low voltage picture element data pulses are also supplied. As a result, each discharge cell is sustained at the state initialized during the simultaneous reset process Rc, namely, at the "light emitting cell" state as it is. By performing the first picture element data write process Wc1, each discharge cell belonging to the display area S1, the upper half of the screen, of the discharge cells of the PDP 10 is set to either the "light emitting cell" state or the "non-light emitting cell" state in accordance with the picture element data PD.

After the execution of the first picture element data write process Wc1, the driver executes the divided light emission sustaining process Ic1, as shown in FIG. 22.

During the divided light emission sustaining process Ic1, first, the first sustain driver 7 simultaneously supplies positive sustaining pulses $IP_X$ as shown in FIG. 23 to the row electrodes $X_1$–$X_k$ belonging to the display area S1. Immediately after the supply of said sustaining pulses $IP_X$, the second sustain driver 8 simultaneously supplies the positive sustaining pulses $IP_Y$ as shown in FIG. 23 to the row electrodes $Y_1$–$Y_k$ belonging to the display area S1. In this case, the pulse width $T_{s1}$ of the sustaining pulses $IP_X$ to be supplied first during the divided light emission sustaining process Ic1 is set wider than the width $T_{s2}$ of the sustaining pulses $IP_Y$ to be supplied secondarily. By the divided light emission sustaining process Ic1, only a discharge cell containing a wall charge out of the discharge cells belonging to the display area S1, namely, only a "light emitting cell" generates a sustaining discharge each time the sustaining pulses $IP_Y$ and $IP_X$ are supplied, and the pulse light is emitted by two frequencies.

At the same timing as that of the divided light emission sustaining process Ic1, the first sustain driver 7 simultaneously supplies positive sustaining pulses $IP_X$ as shown in FIG. 23 to the row electrodes $X_{k+1}$–$X_n$ belonging to the display area S2. In addition, simultaneously with the supply of the sustaining pulses $IP_X$, the second sustain driver 8 simultaneously supplies positive and low level canceling pulses CP as shown in FIG. 23 to the row electrodes $Y_{k+1}$–$Y_n$ belonging to the display area S2. Immediately after the supply of the canceling pulses CP, the second sustain driver 8 simultaneously supplies positive sustaining pulses $IP_Y$ as shown in FIG. 23 to the row electrodes $Y_{k+1}$–$Y_n$ belonging to the display area S2. In this case, although the sustaining pulses $IP_X$ and $IP_Y$ are respectively supplied to the row electrodes $X_{k+1}$–$X_n$ and $Y_{k+1}$–$Y_n$ belonging to the display area S2, the sustaining discharge is not generated because the low level canceling pulses CP are supplied simultaneously with the sustaining pulses $IP_X$.

After the execution of the divided light emission sustaining process Ic1, the driver executes the divided light emission sustaining process Ic2 of the subfield SF1, as is shown in FIG. 22.

During the divided light emission sustaining process Ic2, first, the first sustain driver 7 simultaneously supplies positive sustaining pulses $IP_X$ as shown in FIG. 23 to the row electrodes $X_{k+1}$–$X_n$ which are responsible for the display area S2. In addition, immediately after the supply of said sustaining pulses $IP_X$, the second sustain driver 8 simultaneously supplies the positive sustaining pulses $IP_Y$ as shown in FIG. 23 to the row electrodes $Y_{k+1}$–$Y_n$ responsible for the display area S2. By performing the divided light emission sustaining process Ic2, only a discharge cell in which a wall charge remains out of the discharge cells belonging to the display area S2, the lower half screen of the PDP 10, generates a sustaining discharge each time the sustaining pulses $IP_Y$ and $IP_X$ are supplied. That is, only a discharge cell that had been set to the "light emitting cell" state during said second picture element data write process Wc2 generates a sustaining discharge each time the sustaining pulses $IP_Y$ and $IP_X$ are supplied, and emits the pulse light by two frequencies. At the same timing as that of the divided light emission sustaining process Ic2, the first sustain driver 7 simultaneously supplies positive sustaining pulses $IP_X$ as shown in FIG. 23 to the row electrodes $X_1$–$X_k$ belonging to the display area S1 which forms the upper half screen of the PDP 10. In addition, simultaneously with the supply of the sustaining pulses $IP_X$, the second sustain driver 8 simultaneously supplies positive and low level canceling pulses CP as shown in FIG. 23 to the row electrodes $Y_1$–$Y_k$ belonging to the display area S1. Immediately after the supply of the canceling pulses CP, the second sustain driver 8 simultaneously supplies positive sustaining pulses $IP_Y$ as shown in FIG. 23 to the row electrodes $Y_1$–$Y_k$ belonging to the display area S1. In this case, although the sustaining pulses $IP_X$ and $IP_Y$ are respectively supplied to the row electrodes $X_1$–$X_k$ and $Y_1$–$Y_k$ belonging to the display area S1, the sustaining discharge is not generated because the low level canceling pulses CP are supplied simultaneously with the sustaining pulses $IP_X$.

As shown in FIG. 23, interval Tw1 between the sustaining pulses $IP_X$ to be supplied first during said divided light emission sustaining process Ic1 and the sustaining pulses $IP_Y$ to be supplied secondarily is set wider than interval Tw2 between the sustaining pulses $IP_X$ and the sustaining pulses $IP_Y$ to be supplied during the divided light emission sustaining process Ic2.

After the completion of the divided light emission sustaining process Ic2 for the subfield SF2, the driver executes the second picture element data write process Wc2 for the subfield SF2, as is shown in FIG. 22.

In the same way as in the driving operation shown in FIG. 17, in the driving operation shown in FIG. 22, the time of the divided light emission sustaining process Ic1 responsible for sustaining light emission in the display area S1 and the time of the divided light emission sustaining process Ic2 responsible for sustaining light emission in the display area S2 do not overlap in subfields having less weight. In addition, as is shown in FIG. 23, in the driving operation shown in FIG. 22, the pulse width of the sustaining pulses to be supplied first during each divided light emission sustaining process Ic1 is set wider than the pulse width of the sustaining pulses to be supplied secondarily. Furthermore, in a subfield having less weight, the interval between the sustaining pulses to be supplied first during the divided light emission sustaining process Ic1 and the sustaining pulses to be supplied secondarily is set wider than the interval between the sustaining pulses to be supplied during the divided light emission sustaining process Ic2.

As a result of the consideration described above, the interblock brightness difference between the display areas S1 and S2 which is observed during low brightness display is controlled also in the driving operation shown in FIG. 22.

In the above-mentioned embodiment, the gradation drive is performed by dividing the screen of the PDP 10 into two display areas S1 and S2 and controlling them. However, the number of divided display blocks may be three or more.

FIG. 24 shows an example of a light emission driving format used for driving the gradations of the PDP 10 by dividing the display block into four.

Figures 24A, 24B:
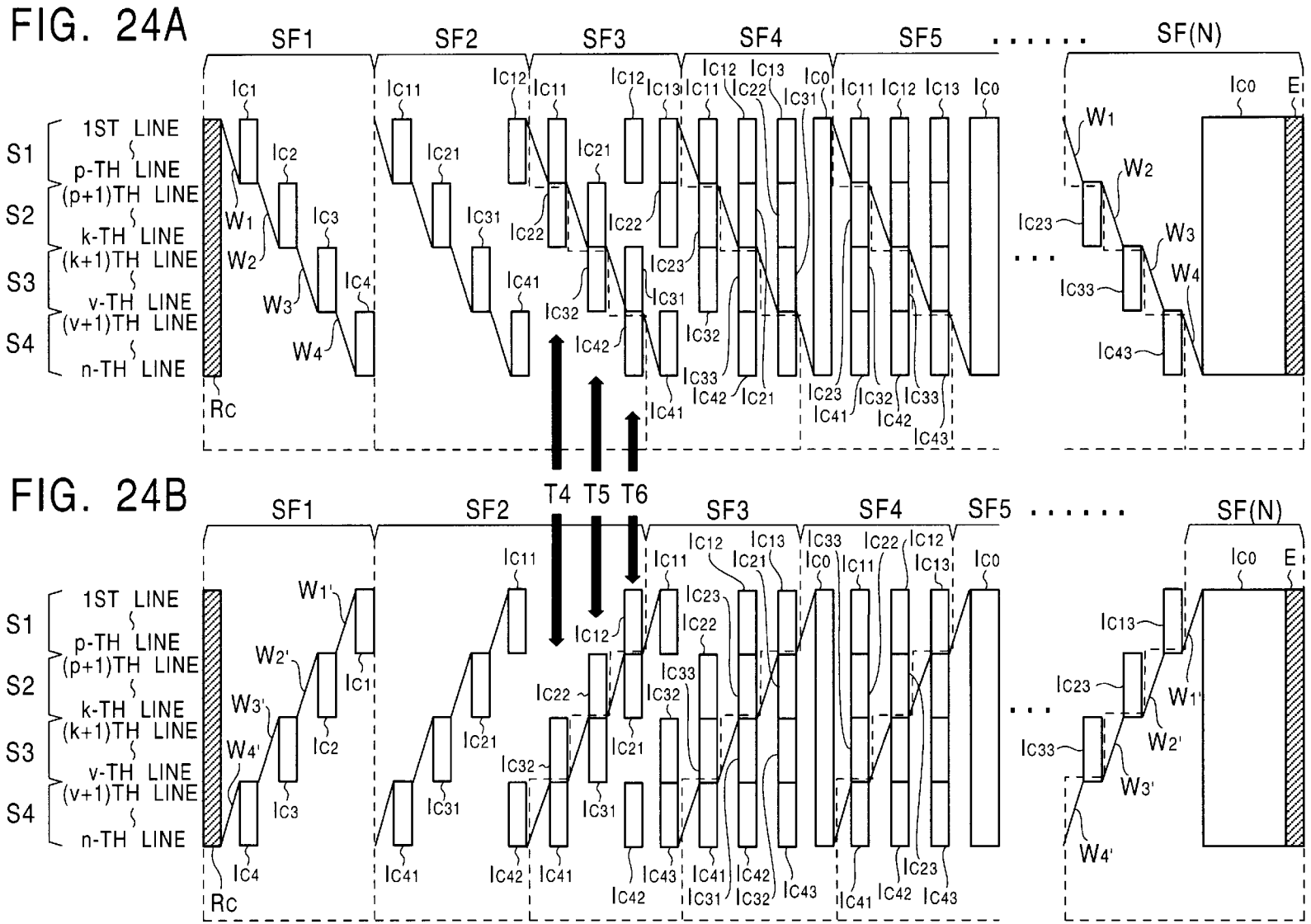
FIGS. 24A and 24B are diagrams showing an example of a light emission driving format based on a further driving method according to the present invention.

The driver drives the gradations of the PDP 10 by switching between the first light emission driving format shown in FIG. 24A and the second light emission driving format shown in FIG. 24B alternately for each display period of one field (or one frame).

According to the first light emission driving format shown in FIG. 24A, first, the driver executes the simultaneous reset process Rc in the first subfield SF1. After the completion of the simultaneous reset process Rc, the driver executes the first picture element data write process Wc1. During the first picture element data write process Wc1, the driver causes each discharge cell belonging to the 1st to p-th display line groups of the PDP 10 (the display area S1) to selectively generate a selective erasing discharge in accordance with the picture element data, and sets each discharge cell to either the "light emitting cell" state or "non-light emitting cell" state. After the completion of the first picture element data write process Wc1, the driver executes the divided light emission sustaining process Ic1. During the divided light emission sustaining process Ic1, the driver causes a discharge cell at the "light emitting cell" state of the discharge cells belonging to the display area S1 to generate a sustaining discharge by two frequencies. After the completion of the divided light emission sustaining process Ic1, the driver executes the second picture element data write process Wc2. During the second picture element data write process Wc2, the driver causes each discharge cell belonging to the (p+1)th to k-th display line groups of the PDP 10 (the display area S2) to selectively generate a selective erasing discharge in accordance with the picture element data, and sets each discharge cell to either the "light emitting cell" state or "non-light emitting cell" state. After the completion of the second picture element data write process Wc2, the driver executes the divided light emission sustaining process Ic2. During the divided light emission sustaining process Ic2, the driver causes discharge cells at the "light emitting cell" state of the discharge cells belonging to the display area S2 of the PDP 10 to generate a sustaining discharge by two frequencies. After the completion of the divided light emission sustaining process Ic2, the driver executes the third picture element data write process Wc3. During the third picture element data write process Wc3, the driver causes discharge cells belonging to the (k+1)th to v-th display line group of the PDP 10 (the display area S3) to selectively generate a selective erasing discharge, and sets each discharge cell to either the "light emitting cell" state or "non-light emitting cell" state. After the completion of the third picture element data write process Wc3, the driver executes the divided light emission sustaining process Ic3. During the divided light emission sustaining process Ic3, the driver causes discharge cells at the "light emitting cell" state of the discharge cells belonging to the display area S3 of the PDP 10 to generate a sustaining discharge by two frequencies. After the completion of the divided light emission sustaining process Ic3, the driver executes the fourth picture element data write process Wc4. During the fourth picture element data write process Wc4, the driver causes discharge cells belonging to the (v+1)th to n-th display line groups of the PDP 10 (the display area S4) to selectively generate a selective erasing discharge in accordance with the picture element data, and sets each discharge cell to either the "light emitting cell" state or "non-light emitting cell" state. After the completion of the fourth picture element data write process Wc4, the driver executes the divided light emission sustaining process Ic4. During the divided light emission sustaining process Ic4, the driver causes discharge cells at the "light emitting cell" state of the discharge cells belonging to the display area S4 of the PDP 10 to generate a sustaining discharge by two frequencies.

After the completion of the divided light emission sustaining process Ic4, the driver executes the first picture element data write process Wc1 for the subfield SF2. After the completion of the first picture element data write process Wc1, the driver executes the first divided light emission sustaining process Ic11. During the first divided light emission sustaining process Ic11, the driver causes discharge cells at the "light emitting cell" state of the discharge cells belonging to the display area S1 to generate a sustaining discharge by two frequencies. After the completion of the first divided light emission sustaining process Ic11, the driver executes the second picture element data write process Wc2 for the subfield SF2. After the completion of the second picture element data write process Wc2, the driver executes the first divided light emission sustaining process Ic21. During the first divided light emission sustaining process Ic21, the driver causes discharge cells at the "light emitting cell" state of the discharge cells belonging to the display area S2 to generate a sustaining discharge by two frequencies. After the completion of the first divided light emission sustaining process Ic21, the driver executes the third picture element data write process Wc3 of the subfield SF2. After the completion of the third picture element data write process Wc3, the driver executes the first divided light emission sustaining process Ic31. During the first divided light emission sustaining process Ic31, the driver causes discharge cells at the "light emitting cell" state of the discharge cells belonging to the display area S3 to generate a sustaining discharge by two frequencies. After the completion of the first divided light emission sustaining process Ic31, the driver executes the fourth picture element data write process Wc4 of the subfield SF2. After the completion of the fourth picture element data write process Wc4, the driver executes the first divided light emission sustaining process Ic41. During the first divided light emission sustaining process Ic41, the driver causes discharge cells at the "light emitting cell" state of the discharge cells belonging to the display area S4 to generate a sustaining discharge by two frequencies. In this case, the driver executes the second divided light emission sustaining process Ic12 at the same timing as that of the first divided light emission sustaining process Ic41. During the second divided light emission sustaining process Ic12, the driver causes discharge cells at the "light emitting cell" state of the discharge cells belonging to the display region S1 to generate a sustaining discharge by two frequencies.

After the completion of the second divided light emission sustaining process Ic12, the driver executes the first picture element data write process Wc1 for the subfield SF3. After the completion of the first picture element data write process Wc1, the driver executes the second divided light emission sustaining process Ic22 for the subfield SF2. During the second divided light emission sustaining process Ic22, the driver causes discharge cells at the "light emitting cell" state of the discharge cells belonging to the display area S2 to generate a sustaining discharge by two frequencies. In addition, the driver executes the first divided light emission sustaining process Ic11 in the subfield SF3 at the same timing as that of the second divided light emission sustaining process Ic22. After the completion of the first divided light emission sustaining process Ic11, the driver executes the second picture element data write process Wc2 in the subfield SF3. After the completion of the second picture element data write process Wc2, the driver executes the second divided light emission sustaining process Ic32 in the subfield SF2. During the second divided light emission sustaining process Ic32, the driver causes discharge cells at the "light emitting cell" state of the discharge cells belonging to the display area S3 to generate a sustaining discharge by two frequencies. In addition, the driver executes the first divided light emission sustaining process Ic21 in the subfield SF3 at the same timing as that of the second divided light emission sustaining process Ic32. After the completion of the first divided light emission sustaining process Ic21, the driver executes the third picture element data write process Wc3 in the subfield SF3. After the completion of the third picture element data write process Wc3, the driver executes the second divided light emission sustaining process Ic42 in the subfield SF2. During the second divided light emission sustaining process Ic42, the driver causes discharge cells at the "light emitting cell" state of the discharge cells belonging to the display area S4 to generate a sustaining discharge by two frequencies. In addition, the driver executes the first divided light emission sustaining process Ic31 and the second divided light emission sustaining process Ic12 in the subfield SF3 simultaneously at the same timing as that of said second divided light emission sustaining process Ic42. After the completion of the second divided light emission sustaining process Ic42, the first divided light emission sustaining process Ic31, and the second divided light emission sustaining process Ic12, the driver executes the fourth picture element data write process Wc4 in the subfield SF3. After the completion of the fourth picture element data write process Wc4, the driver executes the first divided light emission sustaining process Ic41, the second divided light emission sustaining process Ic22, and the third divided light emission sustaining process Ic13 in the subfield SF3 simultaneously. During the third divided light emission sustaining process Ic13, the driver causes discharge cells at the "light emitting cell" state of the discharge cells belonging to the display area S1 to generate a sustaining discharge by two frequencies.

After the completion of the third divided light emission sustaining process Ic13, the driver executes the first picture element data write process Wc1 in the subfield SF4. After the completion of the first picture element data write process Wc1, the driver executes the first divided light emission sustaining process Ic11 in the subfield SF4, the third divided light emission sustaining process Ic23 in the subfield SF3, and the second divided light emission sustaining process Ic32 in the subfield SF3 simultaneously. During the third divided light emission sustaining process Ic23, the driver causes discharge cells at the "light emitting cell" state of the discharge cells belonging to the display area S2 to generate a sustaining discharge by two frequencies. After the completion of these three processes, the driver executes the second picture element data write process Wc2 in the subfield SF4. After the completion of the second picture element data write process Wc2, the driver executes the second divided light emission sustaining process Ic12 in the subfield SF4, the first divided light emission sustaining process Ic21 in the subfield SF4, the third divided light emission sustaining process Ic33 in the subfield SF3, and the second divided light emission sustaining process Ic42 in the subfield SF3 simultaneously. During the third divided light emission sustaining process Ic33, the driver causes discharge cells at the "light emitting cell" state of the discharge cells belonging to the display area S3 to generate a sustaining discharge by two frequencies. After the completion of these four processes, the driver executes the third picture element data write process Wc3 in the subfield SF4. After the completion of the third picture element data write process Wc3, the driver executes the third divided light emission sustaining process Ic13 in the subfield SF4, the second divided light emission sustaining process Ic22 in the subfield SF4, the first divided light emission sustaining process Ic31 in the subfield SF4, and the third divided light emission sustaining process Ic43 in the subfield SF3 simultaneously. During the third divided light emission sustaining process Ic43, the driver causes discharge cells at the "light emitting cell" state of the discharge cells belonging to the display area S4 to generate a sustaining discharge by two frequencies. After the completion of these four processes, the driver executes the fourth picture element data write process Wc4 in the subfield SF4. After the completion of the fourth picture element data write process Wc4, the driver executes the simultaneous light emission sustaining process Ic0 in the subfield SF4. During the simultaneous light emission sustaining process Ic0, the driver causes discharge cells at the "light emitting cell" state of all the discharge cells of the PDP 10 to generate a sustaining discharge by a frequency corresponding to the weight of the subfield SF4. After the completion of said simultaneous light emission sustaining process Ic0, the driver executes the first picture element data write process Wc1 in the subfield SF5. After the completion of the first picture element data write process Wc1, the driver executes the first divided light emission sustaining process Ic11 in the subfield SF5, the third divided light emission sustaining process Ic23 in the subfield SF4, the second divided light emission sustaining process Ic32 in the subfield SF4, and the first divided light emission sustaining process Ic41 in the subfield SF4 simultaneously. After the completion of these four processes, the driver executes the second picture element data write process Wc2 in the subfield SF5. After the completion of the second picture element data write process Wc2, the driver executes the second divided light emission sustaining process Ic12 in the subfield SF5, the first divided light emission sustaining process Ic21 in the subfield SF5, the third divided light emission sustaining process Ic33 in the subfield SF4, and the second divided light emission sustaining process Ic42 in the subfield SF4 simultaneously. After the completion of these four processes, the driver executes the third picture element data write process Wc3 in the subfield SF5. After the completion of the third picture element data write process Wc3, the driver executes the third divided light emission sustaining process Ic13 in the subfield SF5, the second divided light emission sustaining process Ic22 in the subfield SF5, the first divided light emission sustaining process Ic31 in the subfield SF5, and the third divided light emission sustaining process Ic43 in the subfield SF4 simultaneously. After the completion of these four processes, the driver executes the fourth picture element data write process Wc4 in the subfield SF5. After the completion of the fourth picture element data write process Wc4, the driver executes the simultaneous light emission sustaining process Ic0 in the subfield SF5. During the simultaneous light emission sustaining process Ic0, the driver causes discharge cells at the "light emitting cell" state out of all the discharge cells of the PDP 10 to generate a sustaining discharge by a frequency corresponding to the weight of the subfield SF5.

According to the first light emission driving format shown in FIG. 24A, the operation performed in the subfield SF4 is performed in the same manner in the subsequent subfields SF5–SF(N−1). In this case, in the last subfield SF(N), as is shown in the figure, only the simultaneous light emission sustaining process Ic0 is executed after the completion of the first-fourth picture element data write processes (Wc1–Wc4), without executing the above-mentioned first-third divided light emission sustaining processes.

In this case, according to the first light emission driving format shown in FIG. 24A, in the subfields SF4 and after having great weight, the first-third divided light emission sustaining processes and the simultaneous light emission sustaining process are executed at an interval for each of the display areas S1–S4. On the other hand, in the subfield SF1 having less weight, only the first divided light emission sustaining process is executed for each of the display areas S1–S4. In the subfield SF2 having less weight, only the first and second divided light emission sustaining processes are executed at intervals for each of the display areas S1–S4, and in the subfield SF3, only the first-third divided light emission sustaining processes are executed at intervals.

Therefore, according to the first light emission driving format shown in FIG. 24A, the brightness is different between blocks at points T4–T6 in this figure if said third gradation drive (with light emission in SF1–SF2) and said fourth gradation drive (with light emission in SF1–SF3) are executed. That is, at point T4, the discharge cells belonging the display areas S1 and S2 emit light, during said fourth gradation drive period, but only the discharge cells belonging to the display area S1 emit light during said third gradation drive period. Therefore, at the point T4, an interblock brightness difference between the display areas S1 and S2 can be seen. At point T5, the discharge cells belonging to the display areas S2 and S3 emit light during said fourth gradation drive period. However, during the third gradation drive, only the discharge cells belonging to the display area S3 emit light. Accordingly, at point T5, an interblock brightness difference between the display areas S2 and S3 can be seen. At point T6, the discharge cells belonging to the display areas S3 and S4 emit light during said fourth gradation drive period, but only the discharge cells belonging to the display area S4 emit light during said third gradation drive period. Therefore, at the point T6, an interblock brightness difference between the display areas S3 and S4 can be seen.

On the other hand, in the case of the second light emission driving format shown in FIG. 24B, the scanning direction during the picture element data write process according to the first light emission format shown in FIG. 24A is reversed.

That is, in the case of the second light emission driving format shown in FIG. 24B, instead of the first-fourth picture element data write processes Wc1–Wc4 shown in FIG. 24A, the first-fourth picture element data write processes Wc1'–Wc4' are adopted to write the picture element data in the n-th to 1st display lines of the PDP 10. Therefore, as is shown in FIG. 24B, the execution order of the first-third divided light emission sustaining processes to be executed for each of the display areas S1–S4 is opposite to the execution order shown in FIG. 24A.

Therefore, according to the second light emission driving format shown in FIG. 24B, at the point T4, the discharge cells belonging to the display areas S3 and S4 emit light if said third gradation drive and said fourth gradation drive are executed. However, during the third gradation drive, only the discharge cells belonging to the display area S3 emit light. Therefore, at the point T4, an interblock brightness difference between the display areas S3 and S4 can be seen. At the point T5 in the figure, the discharge cells belonging to the display areas S2 and S3 emit light during said fourth gradation drive period. However, during the third gradation drive, only the discharge cells belonging to the display area S2 emit light. Accordingly, at the point T5, an interblock brightness difference between the display areas S2 and S3 can be seen. At point T6, the discharge cells belonging to the display areas S1 and S2 emit light during said fourth gradation drive period, but only the discharge cells belonging to the display area S1 emit light. Therefore, at the point T6, an interblock brightness difference between the display areas S1 and S2 can be seen.

That is, in the case of the first and second light emission drive formats, the display block pairs with an interblock brightness difference between them at the points T4–T6 and the brightness level between the display blocks differ from each other. Therefore, by performing gradation drive for the PDP 10, switching between the first light emission drive format and the second light emission drive format alternately for each one field display period, apparent interbock brightness difference can be reduced.

As described above in detail, according to the present invention, the first and second picture element data write processes are executed for writing the picture element data in the discharge cells belonging to the first and second display areas of the plasma display panel in each subfield. In addition, the first and second light emission sustaining processes are executed for brightening only the discharge cells in the light emission cell state out of the discharge cells belonging to said first and second display areas. In this case, in the subfield having less weight in each subfield, said first light emission sustaining process is executed immediately after the completion of said first picture element data write process. Said second picture element data write process is then executed immediately after the first light emission sustaining process. Said second light emission sustaining process is executed immediately after the completion of said second picture element data write process.

Thus, each light emission sustaining process is executed before the extinction of charged particles in the discharge cell. Therefore, even though the pulse width of each light emission sustaining pulse to be supplied is narrowed during this light emission sustaining process, the light emission sustaining charge takes place properly. So, by shortening the time required for the light emission sustaining process by narrowing the pulse width of each sustaining pulse, and by increasing the number of the subfields using the time obtained by such time shortening process, the number of displayable gradations increases and a high-quality image can be obtained.

In addition, according to the present invention, in a subfield having less weight, the light emission processes which are executed for each display area do not overlap with each other, so an interblock brightness difference between each display area can be prevented during low-brightness display.

Therefore, according to the present invention, a high-quality image with high gradation can be obtained.

This application is based on Japanese Patent Application No. 2000-168067 which is hereby incorporated by reference.

What is claimed is:

1. A method for driving the gradations of a plasma display panel in which a discharge cell responsible for a picture element is formed at each intersection between each row electrode corresponding to each display line and each column electrode intersected with said row electrode by using each field of an input video signal comprising a plurality of subfields, said method comprising:

in each of said subfields, executing a first picture element data write process in response to picture element data corresponding to said input video signal, for setting said discharge cells belonging to each of a plurality of said display lines responsible for a first display area of said plasma display panel to either a light emitting state or a non-light emitting state;

executing a second picture element data write process in response to said picture element data, for setting said discharge cells belonging to each of a plurality of said display lines responsible for a second display area of said plasma display panel to either said light emitting state or said non-light emitting state;

executing a first light emission sustaining process for causing only the discharge cells in a light emitting state out of said discharge cells belonging to said first display area by a frequency corresponding to the weight of said subfield; and executing a second light emission sustaining process for causing only the discharge cells in light emitting state of said discharge cells belonging to said second display area by a frequency corresponding to the weight of said subfield:

wherein, in a subfield with less weight of each of said subfield, said first light emission sustaining process is executed immediately after the completion of said first picture element data write process and said second picture element data write process is executed immediately after the completion of said first light emission sustaining process, and said second light emission sustaining process is executed immediately after the completion of said second picture element data write process.

2. A method for driving a plasma display panel according to claim 1, wherein in a subfield with greater weight of said subfields, said first light emission sustaining process comprises a first divided light emission sustaining process for causing only the discharge cells in said light emitting state of said discharge cells belonging to said first display area to discharge for sustaining the light emission cell state, and a simultaneous light emission sustaining process for causing only the discharge cells in said light emitting cell state to discharge for the sustaining light emission state by a frequency corresponding to the weight of said subfield;

said second light emission sustaining process comprises a second divided light emission sustaining process for causing only the discharge cells in said light emitting cell state of said discharge cells belonging to said second display area to discharge for sustaining the light emission state by a predetermined frequency, and a simultaneous light emission sustaining process; and said first divided light emission sustaining process is executed immediately after the completion of said first picture element data write process, said second picture element data write process is executed immediately after the completion of said first divided light emission sustaining process, said simultaneous light emission sustaining process is executed immediately after the completion of said second picture element data write process, said first picture element data write process is executed immediately after the completion of said simultaneous light emission sustaining process in the next subfield, and said second divided light emission sustaining process is executed immediately after the completion of said first picture element write process.

3. A method for driving a plasma display panel according to claim 1, wherein:

a simultaneous reset process is executed for initializing all of said discharge cells to said light emitting cell state by generating a wall charge in said discharge cells by discharging all of said discharge cells for resetting only in said subfield at the head of said one field;

each of said discharge cells belonging to said first display area is set to said non-light emitting cell state by discharging each cell selectively for erasing in response to said picture element data only in said first picture element data write process for one of said subfields; and each of said discharge cells belonging to said second display area is set to said non-light emitting cell state by discharging each cell selectively for erasing in response to said picture element data only in said second picture element data write process for one of said subfields.

4. A method for driving the gradations of a plasma display panel in which a discharge cell responsible for a picture element is formed at each intersection between each row electrode corresponding to each display line and each column electrode intersected with said row electrode by using each field of an input video signal comprising a plurality of subfields, said method comprises:

in each said subfield, executing a first picture element data write process is in response to picture element data corresponding to said input video signal, for setting said discharge cells belonging to each of a plurality of said display lines responsible for a first display area of said plasma display panel to either a light emitting cell state or a non-light emitting cell state;

executing a second picture element data write process in response to said picture element data, for setting said discharge cells belonging to each of a plurality of said display lines responsible for a second display area of said plasma display panel to either said light emitting cell state or said non-light emitting cell state;

executing a first divided light emission sustaining process for causing only discharge cells in said light emitting cell state of said discharge cells belonging to said first display area by a predetermined frequency;

executing a second divided light emission sustaining process for causing only the discharge cells in light emitting state of said discharge cells belonging to said second display area by a predetermined frequency for sustaining light emitting state; and execting a simultaneous light emission sustaining process for causing only the discharge cells in said light emitting state of said discharge cells by a frequency corresponding to the weight of said subfield, wherein, in a subfield with less weight of said subfields, a first sequence in which said first divided light emission sustaining process is executed immediately after the completion of said first picture element data write process, said second picture element data write process is executed immediately after the completion of said first light emission sustaining process, said simultaneous light emission sustaining process is executed immediately after the completion of said second picture element data write process, said first picture element data write process is executed immediately after the completion of said simultaneous light emission sustaining process in the next subfield, and said second divided light emission sustaining process is executed immediately after the completion of said first picture element data write process; and a second sequence in which said first divided light emission sustaining process is executed immediately after the completion of said first picture element data write process, said second picture element data write process is executed immediately after the completion of said first divided light emission sustaining process, said second divided light emission sustaining process is executed immediately after the completion of said second picture element data write process, and said simultaneous light emission sustaining process is executed immediately after the completion of said second divided light emission sustaining process are executed alternately.

5. A method for driving a plasma display panel according to claim 4, wherein:

in a subfield having greater weight of said subfields, said first divided light emission sustaining process is executed immediately after the completion of said first picture element data write process, said second picture element data write process is executed immediately after the completion of said first divided light emission sustaining process, said simultaneous light emission sustaining process is executed immediately after the completion of said second picture element data write process, said first picture element data write process is executed immediately after the completion of said simultaneous light emission sustaining process in the next subfield, and said second divided light emission sustaining process is executed immediately after the completion of said first picture element data write process.

6. A method for driving a plasma display panel according to claim 4, characterized in that:

a simultaneous reset process is executed for initializing all of said discharge cells to said light emitting cell state by generating a wall charge in said discharge cells by discharging all of said discharge cells for resetting only in said subfield at the head of said one field;

each of said discharge cells belonging to said first display area is set to said non-light emitting cell state by discharging each cell selectively for erasing in response to said picture element data only in said first picture element data write process for one of said subfields;

each of said discharge cells belonging to said second display area is set to said non-light emitting cell state by discharging each cell selectively for erasing in response to said picture element data only in said second picture element data write process for one of said subfields.

7. A method for driving the gradations of a plasma display panel in which a discharge cell responsible for a picture element is formed at each intersection between each row electrode corresponding to each display line and each column electrode intersected with said row electrode by using each field of an input video signal comprising a plurality of subfields, said method comprising:

in each said subfield, executing a first picture element data write process is executed in response to picture element data corresponding to said input video signal, for setting said discharge cells belonging to each of a plurality of said display lines responsible for a first display area of said plasma display panel to either a light emitting state or a non-light emitting state;

executing a second picture element data write process in response to said picture element data, for setting said discharge cells belonging to each of a plurality of said display lines responsible for a second display area of said plasma display panel to either said light emitting state or said non-light emitting state;

executing a first divided light emission sustaining process for supplying sustaining pulses to brighten the discharge cells in said light emitting cell state of said discharge cells belonging to said first display area by a predetermined frequency;

a second divided light emission sustaining process is executed for supplying light emission sustaining pulses to brighten the discharge cells in said light emitting cell state of each of said discharge cells belonging to said second display area by a predetermined frequency; and executing a simultaneous light emission sustaining process for supplying said sustaining pulses for causing said discharge cells in said light emitting cell state out of all of said discharge cells to brighten for sustaining the light emission cell state by a frequency corresponding to the weight of said subfields, wherein, in each subfield with less weight of each of said subfield:

said first divided light emission sustaining process is executed immediately after the completion of said first picture element data write process, said second divided light emission sustaining process is executed immediately after the completion of said first divided light emission sustaining process in said subfield;

said second picture element data write process is executed immediately after the completion of said second divided light emission sustaining process, said simultaneous light emission sustaining process is executed immediately after the completion of said second picture element data write process; and said first picture element data write process and said first divided light emission sustaining process are sequentially executed immediately after the completion of said simultaneous light emission sustaining process in said next subfield and then said second divided light emission sustaining process is executed.

8. A method for driving a plasma display panel according to claim 7, wherein in a subfield having greater weight of each of said subfields:

said first divided light emission sustaining process is executed immediately after the completion of said first picture element data write process;

said second picture element data write process is executed immediately after the completion of said first divided light emission sustaining process, said simultaneous light emission sustaining process is executed immediately after the completion of said second picture element data write process; and said first picture element data write process is executed immediately after the completion of said simultaneous light emission sustaining process in the next subfield, and the second divided light emission sustaining process is executed immediately after the completion of said first picture element data write process.

9. A method for driving a plasma display panel according to claim 7, wherein:

a simultaneous reset process is executed for initializing all of said discharge cells to said light emitting cell state by generating a wall charge in said discharge cells by discharging all of said discharge cells for resetting only in said subfield at the head of said one field;

each of said discharge cells belonging to said first display area is set to said non-light emitting state by discharging each cell selectively for erasing in response to said picture element data only in said first picture element data write process for one of said subfields; and each of said discharge cells belonging to said second display area is set to said non-light emitting cell state by discharging each cell selectively for erasing in response to said picture element data only in said second picture element data write process for one of said subfields.

10. A method for driving a plasma display panel according to claim 7, wherein in said first divided light emission process in a subfield with less weight of said subfields, the pulse width of the first one of said sustaining pulses to be supplied is broadened wider than that of the second one of said sustaining pulses to be supplied.

11. A method for driving a plasma display panel according to claim 7, wherein the interval between a first one and a second one of said sustaining pulses in said first divided light emission process of a subfield with less weight of said subfields is wider than the interval between a first one and a second one of said sustaining pulses to be supplied in said second divided light emission process of a subfield with less weight.

12. A method for driving the gradations of a plasma display panel in which a discharge cell responsible for a picture element is formed at each intersection between each row electrode corresponding to each display line and each column electrode intersected with said row electrode by using each field of an input video signal comprising a plurality of subfields, said method comprising:

in each said subfield, executing a picture element data write process in response to picture element data corresponding to said input video signal, for setting each of said discharge cells to either a light emitting cell state or a non-light emitting cell state by one display line; and executing a light emission sustaining process for emitting discharge cells in said light emitting cell state only out of the discharge cells belonging to said one display line group immediately after each completion of said picture element data write process for said discharge cells belonging to one display line group of each of a plurality of said display line groups consisting of each of said display lines, wherein the write scanning direction of said picture element data for said display line is changed for each field.

13. A method for driving the plasma display panel according to claim 12, wherein:

a simultaneous reset process is executed for initializing all of said discharge cells to said light emitting cell state by generating a wall charge in said discharge cells by discharging all of said discharge cells for resetting only in said subfield at the head of said one field; and each of said discharge cells is set to said non-light emitting cell state by discharging each cell selectively for erasing in response to said picture element data only in said picture element data write process for one of said subfields.

* * * * *